US006155675A

United States Patent [19]

Nice et al.

[11] Patent Number: 6,155,675

[45] **Date of Patent: *Dec. 5, 2000**

[54] PRINTHEAD STRUCTURE AND METHOD FOR PRODUCING THE SAME

[75] Inventors: Lee Van Nice, Corvallis; Gerald E. Heppell, Tigard; Neal W. Meyer, Corvallis; Donald L. Michael, Monmouth, all of Oreg.; Kit Baughman, Escondido, Calif.; Thach G. Troung; Rui Yang, both of Austin, Tex.; Moses M. David, Woodbury, Minn.; James R. White, Round Rock, Tex.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/921,678

[22] Filed: Aug. 28, 1997

[51] Int. Cl.[7] ..... B41J 2/05

[52] U.S. Cl. ..... 347/63

[58] Field of Search ..... 347/65, 63, 45, 347/47

[56] References Cited

U.S. PATENT DOCUMENTS

| | | | |
|---|---|---|---|
| 3,958,255 | 5/1976 | Chiou et al. . | |
| 4,007,464 | 2/1977 | Bassous | 347/47 |
| 4,329,698 | 5/1982 | Smith . | |
| 4,368,476 | 1/1983 | Uehara et al. . | |
| 4,500,895 | 2/1985 | Buck et al. . | |
| 4,623,906 | 11/1986 | Chandrashekhar | 347/45 X |
| 4,643,948 | 2/1987 | Diaz et al. . | |
| 4,661,409 | 4/1987 | Kieser et al. . | |
| 4,663,640 | 5/1987 | Ikeda . | |
| 4,698,256 | 10/1987 | Giglia et al. . | |
| 4,740,263 | 4/1988 | Imai et al. . | |
| 4,749,291 | 6/1988 | Kobayashi et al. . | |
| 4,771,295 | 9/1988 | Baker et al. . | |
| 4,847,639 | 7/1989 | Sugata et al. . | |
| 4,864,329 | 9/1989 | Kneezel et al. | 347/93 |
| 4,890,126 | 12/1989 | Hotomi . | |
| 4,944,850 | 7/1990 | Dion . | |
| 5,073,785 | 12/1991 | Jansen et al. | 347/45 |
| 5,189,787 | 3/1993 | Reed et al. . | |
| 5,208,606 | 5/1993 | Klein | 347/45 |

(List continued on next page.)

FOREIGN PATENT DOCUMENTS

| | | | |
|---|---|---|---|
| 59-176054 | 10/1984 | Japan | B41J 3/04 |
| 60-054858 | 3/1985 | Japan . | |
| 61-58744 | 3/1986 | Japan | B41J 3/04 |
| 2-223451 | 9/1990 | Japan . | |
| 07-125219 | 5/1995 | Japan | B41J 2/135 |
| 08-267755 | 10/1996 | Japan | B41J 2/16 |
| 09-076511 | 3/1997 | Japan . | |
| WO 95/20253 | 7/1995 | WIPO . | |
| WO95/20253 | 7/1995 | WIPO . | |

OTHER PUBLICATIONS

Anonymous: "Diamond–like Carbon Coated Silicon Nozzle"IBM Technical Disclosure Bulletin, vol. 36, no. 6A, Jun. 1 1993 pp. 423–424, XP002137394, New York, US.

(List continued on next page.)

*Primary Examiner*—John Barlow
*Assistant Examiner*—Charles W. Stewart, Jr.

[57] ABSTRACT

A high-durability printhead for an ink cartridge printing system. The printhead includes a substrate having ink ejectors (e.g. resistors) thereon and an orifice plate positioned above the substrate. The orifice plate (which preferably involves a non-metallic polymer film) has a top surface, bottom surface and a plurality of openings therethrough. To improve the durability of the orifice plate, a protective coating is applied to the top surface and/or the bottom surface of the plate. Representative coatings involve dielectric compositions (including diamond-like carbon) or at least one layer of metal. This approach improves the abrasion and deformation resistance of the plate and avoids "ruffling" and "dimpling" problems.

14 Claims, 6 Drawing Sheets

U.S. PATENT DOCUMENTS

| | | | |
|---|---|---|---|
| 5,229,785 | 7/1993 | Leban | 347/47 |
| 5,278,584 | 1/1994 | Keefe et al. | 347/63 |
| 5,305,015 | 4/1994 | Schantz et al. | 347/47 |
| 5,312,517 | 5/1994 | Ouki | 347/47 X |
| 5,387,440 | 2/1995 | Takemoto | 347/45 X |
| 5,426,458 | 6/1995 | Wenzel et al. . | |
| 5,443,687 | 8/1995 | Koyama et al. . | |
| 5,493,320 | 2/1996 | Sandbach, Jr. et al. | 347/47 |
| 5,508,230 | 4/1996 | Anderson et al. . | |
| 5,516,500 | 5/1996 | Liu et al. . | |
| 5,594,479 | 1/1997 | Inoue | 347/47 X |
| 5,653,901 | 8/1997 | Yoshimura | 347/47 X |

OTHER PUBLICATIONS

*Hewlett–Packard Journal, vol. 39, No. 4 (Aug. 1988) Technology,*McGraw–Hill Book Company, New York, 1982, pp. 1–41.

Document entitled: "Brilliant Discovery,"by QQC, Inc., 5/13/96.

Article by Advance Refractory Technologies, Inc., "Dylyn : A Novel Coating with Unique Properties", White Paper 96–110.

*Hewlett–Packard Journal,* vol. 39, No. 4 (Aug. 1988).

Elliott, D.J., *Integrated Circuit Fabrication Technology,* McGraw–Hill Book Company, New York, 1982, pp. 1–41. Chapter 3 page 9.

Document entitled: "Brilliant Discovery", by QQC, Inc., 5/13/96.

Article by Advanced Refractory Technologies, Inc. "Dylyn : A Novel Coating with Unique Properties", White Paper 96 –010.

PRINTHEAD STRUCTURE AND METHOD FOR PRODUCING THE SAME

BACKGROUND OF THE INVENTION

The present invention generally relates to printing technology, and more particularly involves an improved, high-durability printhead and orifice plate structure for use in an ink cartridge (e.g. a thermal inkjet system). The present invention is related to U.S. application Ser. No. 08/922272 (docket no. 10960551) "Printhead for an Inkjet Cartridge and Method for Producing the Same", filed on behalf of Neal W. Meyer et al. on the same date hereof and assigned to the same assignee.

Substantial developments have been made in the field of electronic printing technology. Specifically, a wide variety of highly-efficient printing systems currently exist which are capable of dispensing ink in a rapid and accurate manner. Thermal inkjet systems are especially important in this regard. Printing systems using thermal inkjet technology basically involve a cartridge which includes at least one ink reservoir chamber in fluid communication with a substrate having a plurality of resistors thereon. Selective activation of the resistors causes thermal excitation of the ink and expulsion of the ink from the cartridge. Representative thermal inkjet systems are discussed in U.S. Pat. No. 4,500,895 to Buck et al.; U.S. Pat. No. 4,771,295 to Baker et al.; U.S. Pat. No. 5,278,584 to Keefe et al.; and the Hewlett-Packard Journal, Vol. 39, No. 4 (August 1988), all of which are incorporated herein by reference.

In order to effectively deliver ink materials to a selected substrate, thermal inkjet printheads typically include an outer plate member known as an "orifice plate" or "nozzle plate" which includes a plurality of ink ejection orifices (e.g. openings) therethrough. Initially, these orifice plates were manufactured from one or more metallic compositions including but not limited to gold-plated nickel and similar materials. However, recent developments in thermal inkjet printhead design have resulted in the production of orifice plates which are non-metallic in character, with the term "non-metallic" being defined to involve one or more material layers which are devoid of elemental metals, metal amalgams, or metal alloys. In a preferred embodiment, these non-metallic orifice plates are produced from a variety of different organic polymers including but not limited to film products consisting of polytetrafluoroethylene (e.g. Teflon®), polyimide, polymethylmethacrylate, polycarbonate, polyester, polyamide, polyethyleneterephthalate, and mixtures thereof. A representative polymeric (e.g. polyimide-based) composition which is suitable for this purpose is a commercial product sold under the trademark "KAPTON" by E. I. DuPont de Nemours and Company of Wilmington, Del. (USA). Orifice plate structures produced from the non-metallic compositions described above are typically uniform in thickness, with an average thickness range of about 1.0–2.0 mil. Likewise, they provide numerous benefits ranging from reduced production costs to a substantial simplification of the printhead structure which translates into improved reliability, performance, economy, and ease of manufacture. The fabrication of film-type, non-metallic orifice plates and the corresponding production of the entire printhead structure is typically accomplished using conventional tape automated bonding ("TAB") technology as generally discussed in U.S. Pat. No. 4,944,850 to Dion. Likewise, further detailed information regarding polymeric, non-metallic orifice plates of the type described above are discussed in the following U.S. Pat. No. 5,278,584 to Keefe et al. and U.S. Pat. No. 5,305,015 to Schantz et al.

However, a primary consideration in the selection of any material to be used in the production of an inkjet orifice plate (especially the polymeric compositions listed above) is the overall durability of the completed plate structure. The term "durability" as used herein shall encompass a wide variety of characteristics including but not limited to abrasion and deformation resistance. Both abrasion and deformation of the orifice plate can occur during contact between the orifice plate and a variety of structures encountered during the printing process including wiper-type structures (normally made of rubber and the like) which are typically incorporated within conventional printing systems.

Deformation and abrasion of the orifice plate not only decreases the overall life of the printhead and cartridge associated therewith, but can also cause a deterioration in print quality over time. Specifically, deformation of the orifice plate can result in the production of printed images which are distorted and indistinct with a corresponding loss of resolution. The term "durability" also encompasses a situation in which the orifice plate is sufficiently rigid to avoid problems associated with "dimpling". Dimpling traditionally involves a situation in which orifice plates made of non-metallic, polymer-containing materials undergo deformation during assembly of the printhead or cartridge such that the orifice plate becomes essentially non-planar and the nozzle axis is misdirected. Ruffling is typically caused by physical abrasion of the orifice plate such as with a printer wiper, and is likewise associated with of the nozzle exit. Ruffling and dimpling present substantial problems including misdirection of the ink droplets being expelled from the printhead which results in improperly-printed images. Accordingly, all of these factors are important in producing a completed thermal inkjet system which has a long life-span and is capable of producing clear and distinct images throughout the life-span of the system.

Prior to development of the present invention, a need existed for an inkjet orifice plate manufactured from non-metallic organic polymer compositions (as well as metallic compounds) having improved durability characteristics. Likewise, a need remained for a printhead having a high level of structural integrity. The present invention satisfies these goals in a unique manner by providing a specialized printhead and orifice plate structure which are characterized by improved durability levels, with these components being applicable to both thermal inkjet and other types of inkjet printing systems. Accordingly, the claimed invention represents a substantial advance in inkjet printing technology as discussed in detail below.

SUMMARY OF THE INVENTION

It is an object of the present invention to provide an improved inkjet printing system (especially a thermal inkjet printing unit).

It is another object of the invention to provide an improved inkjet printing system which includes a specialized orifice plate that is characterized by a high level of durability, namely, resistance to abrasion, deformation, and dimpling.

It is another object of the invention to provide an improved inkjet printing system having a specialized orifice plate which is produced from a non-metallic organic polymer composition and is treated in a unique manner to improve durability levels.

It is further object of the invention to provide an improved inkjet printing system having a specialized orifice plate which is readily manufactured and applied to many different types of ink cartridge systems including thermal inkjet units.

It is a still further object of the invention to provide an improved inkjet printing system having a specialized orifice plate which is capable of being manufactured using mass production techniques in order to substantially reduce manufacturing costs.

It is an even further object of the invention to provide an improved inkjet printing system (e.g. a thermal inkjet printing apparatus) having a specialized printhead which includes a non-metallic, organic polymer-based orifice plate having an outer coating comprised of at least one or more material layers designed to protect the orifice plate from abrasion, deformation, dimpling, and the like.

It is an even further object of the invention to provide unique fabrication processes in which the claimed orifice plate and printhead are manufactured in a rapid and efficient manner so that the desired goals can be achieved.

In accordance with the present invention, a unique inkjet printhead system is provided which includes a non-metallic orifice plate that is characterized by a high level of durability and strength. Even though the orifice plate is typically produced from a non-metallic organic polymer film of normal thickness (e.g. about 25–50 $\mu$m), it is abrasion resistant and likewise avoids problems associated with deformation and "dimpling" as defined above. As a result, the operating efficiency and life-span of the cartridge unit are substantially improved. The following discussion represents a brief summary of the claimed invention. More specific and comprehensive information will be provided below in the Detailed Description of Preferred Embodiments section. It should also be noted that while the present invention shall be discussed herein with primary reference to thermal inkjet systems, it is likewise applicable to other types of inkjet printing devices as listed below. Accordingly, the invention may be used in connection with any type of ink cartridge system which includes an orifice plate having multiple openings therethrough that is positioned above a substrate having one or more ink ejection devices ("ejectors") thereon. Thus, the claimed invention shall not be restricted to any particular type of inkjet printing technology.

In accordance with the present invention, an improved printhead structure is provided which basically includes an ink expulsion system comprising two main components. First, a substrate is employed which is typically made of silicon. The substrate has an upper surface comprising at least one and preferably multiple ink ejectors thereon (e.g. devices which eject or expel ink from the printhead). In a preferred and non-limiting embodiment to be discussed herein which involves thermal inkjet technology, the substrate will include multiple thin-film heating resistors thereon (e.g. of a tantalum-aluminum type) which are used to selectively heat, vaporize, and expel ink materials from the completed printhead. As discussed further below, the substrate in a thermal inkjet system will likewise include a plurality of logic transistors and associated metallic traces (conductive pathways) thereon which electrically communicate with the resistors so that they may be heated on-demand.

Fixedly positioned over and above the upper surface of the substrate having the ink ejectors (e.g. heating resistors) thereon is an orifice plate member. In the present invention, the orifice plate is preferably comprised of a non-metallic, organic polymer film composition. Many different materials may be used for this purpose, with the claimed invention not being limited to any particular organic polymers. For example, the following compositions involve representative organic polymers which may be employed to produce the orifice plate: polytetrafluoroethylene (e.g. Teflon®), polyimide, polymethylmethacrylate, polycarbonate, polyester, polyamide, polyethylene-terephthalate, and mixtures thereof. The use of a film-type organic polymer for the orifice plate in the claimed invention provides numerous benefits compared with traditional metal orifice plates (e.g. gold-plated nickel) including a reduction in material costs and improved manufacturing efficiency. In particular, orifice plates manufactured from organic polymer compositions are well-suited for use in connection with tape automated bonding ("TAB") production methods as discussed below. The orifice plate also comprises a top surface, a bottom surface, and a plurality of openings (e.g. "orifices") passing entirely through the orifice plate, with each of the openings providing access to (and typically positioned on the same axis with) at least one of the ink ejectors (e.g. resistors) on the upper surface of the underlying substrate Finally, in accordance with the claimed invention, a protective layer of coating material is positioned on at least one of the top surface and the bottom surface of the orifice plate (e.g. adjacent to and surrounding the openings through the orifice plate in a preferred embodiment). This step in which a non-metallic, organic polymer-based orifice plate is coated with a layer of a protective material represents a departure from conventional methods. This approach not only provides the inherent benefits associated with the use of non-metallic organic polymer films to produce the orifice plate as discussed above, but likewise results in a completed structure that is resistant to abrasion, deformation, and dimpling.

Many specialized compositions can be used to provide the protective layer of coating material on the polymeric orifice plate. For example, a selected dielectric composition can be employed, with the term "dielectric" being defined to involve materials which are electrically-insulating and substantially non-conductive. Representative dielectric materials suitable for this purpose include but are not limited to silicon nitride ($Si_3N_4$), boron nitride (BN), silicon dioxide ($SiO_2$), silicon carbide (SiC), and a composition known as "silicon carbon oxide" which is commercially available under the name Dylyn® from Advanced Refractory Technologies, Inc. of Buffalo, N.Y. (USA). Likewise, many different methods and processing sequences may be used to deposit these materials onto the orifice plate, with the present invention not be restricted to any particular manufacturing techniques. For example, as discussed below, application of these materials may be achieved using a number of known procedures including plasma vapor deposition, chemical vapor deposition, sputtering, deposition processes, and others. The protective layer of coating material may likewise be applied at any stage during the production process, although it is preferred this step be undertaken during manufacture of the thin-film polymeric orifice plate and before it is attached to any other printhead components. However, the reaction sequence associated with this step can be varied in accordance with the particular materials being processed and the selected compositions used to produce the layer of coating material as determined by preliminary pilot testing.

Another important material having dielectric properties, as well as a substantial level of durability and abrasion-resistance is a composition known as "diamond-like carbon" or "DLC". This material (which will be described in considerable detail below) is also known as "amorphous carbon". Many different methods and processing sequences may be employed to deposit DLC onto the top and/or bottom surface of the orifice plate, with the claimed invention not being restricted to any particular manufacturing techniques. The application of DLC to the orifice plate may again be accomplished using a number of known processes including plasma vapor deposition, chemical vapor deposition, sputtering, deposition processes, and others. The protective layer of DLC may be applied at any stage during the production process, although it is again preferred that this step be accomplished during production of the polymeric orifice plate before it is secured to any other printhead components. However, the reaction sequence associated with this step may be varied in accordance with the particular materials being processed.

Regardless of which dielectric composition is selected for delivery to the orifice plate (e.g. DLC or others), it is preferred that it be positioned on at least the top surface of the orifice plate. However, it is likewise contemplated in alternative embodiments of the invention that the selected layer of dielectric material can be applied to (1) both the top and bottom surfaces of the orifice plate; and (2) only the bottom surface of the plate as discussed below. Accordingly, application of the layer of dielectric coating material to "at least one" of the top and bottom surfaces of the orifice plate shall encompass both of the alternatives listed above as well as the initial embodiment in which the coating material is only applied to the top surface of the plate. It is also contemplated that the application of dielectric materials (e.g. DLC or others) to the orifice plate may also involve orifice plates of more conventional design including plates made of metal such as gold-plated nickel. Thus, while the invention shall be discussed below with primary reference to polymeric, non-metallic orifice plates, it is likewise applicable to metallic orifice plate systems in order to provide improved abrasion resistance and other benefits. The use of DLC on the bottom surface of the orifice plate provides the additional benefit of enhanced adhesion between the orifice plate and the underlying layers of material in the printhead (e.g. the barrier layer discussed below). This enhanced level of adhesion is directly provided by the unique chemical character of DLC which will also be addressed in additional detail below.

As previously stated, it is a unique feature of the claimed invention to apply the above-described materials (e.g. DLC or other dielectric compositions) to an orifice plate (especially one made from a non-metallic, organic polymer-based composition). In accordance with a further embodiment of the invention which is equally unique (especially in connection with non-metallic orifice plates), a protective layer of coating material is positioned on at least one of the top surface and the bottom surface of the orifice plate, with the protective layer consisting of at least one metal composition. The term "metal composition" as used herein is defined to involve an elemental metal, a metal alloy, or a metal amalgam. Specifically, one or more layers of a selected metal composition are applied to the top and/or bottom surface of the orifice plate using conventional techniques (e.g. chemical vapor deposition, plasma vapor deposition, sputtering, deposition processes, and the like). This embodiment of present invention shall not be restricted to any particular deposition methods, any number of metal-containing layers, or any specific metal compositions. Representative metals which may be applied in one or more discrete layers on the polymeric orifice plate include chromium (Cr), nickel (Ni), palladium (Pd), gold (Au), titanium (Ti), tantalum (Ta), aluminum (Al), rhodium (Rh), and mixtures (e.g. compounds) thereof. Likewise, many different methods and processing sequences may be employed to apply the selected metal compositions to the orifice plate, with the present invention not be limited to any particular manufacturing techniques. The protective metallic composition may be applied at any stage during the production process, although it is again preferred that this step be accomplished during manufacture of the polymeric orifice plate and before it is attached to any other printhead components. However, the reaction sequence associated with this step may be varied in accordance with the particular materials being processed and the selected compositions used to produce the metallic layer(s) of coating material as determined by preliminary testing.

In summary, this embodiment of the claimed invention involves the delivery of one or more layers of a selected metal composition to the polymeric orifice plate which is a unique development. While the delivery of one or more metal-containing layers to the orifice plate is encompassed within the broad concept of the invention, a representative, non-limiting example of this embodiment involves the delivery of three separate metal layers to the top surface of the orifice plate. Specifically, a first metallic coating layer is positioned on the upper surface of the orifice plate which consists of a first metal composition. The first metal composition is designed to function as a "seed" layer which enables proper adhesion of the other metal layers to the polymeric orifice plate. Representative metals suitable for this purpose include chromium (Cr), nichrome, tantalum nitride, tantalum-aluminum, and mixtures thereof. Next, a second metallic coating layer is positioned on the first metallic coating layer. The second metallic coating layer is comprised of a second metal composition that is designed to provide added strength and rigidity. Exemplary metals suitable for this purpose in the above-listed 3-layer embodiment are preferably different from the metals listed above in connection with the first metal composition, and will include nickel (Ni), titanium (Ti), and copper (Cu). Finally, a third metallic coating layer is positioned on the second metallic coating layer. The third metallic coating layer is comprised of a third metal composition that is designed to provide corrosion resistance and smoothness. Representative metal compositions appropriate for this purpose are preferably different from the metals listed above in connection with the second metal composition, and will include gold (Au), platinum (Pt), and palladium (Pd).

Regarding the selected metallic layer(s) to be deposited onto the orifice plate in this embodiment, it is preferred that these materials be delivered to at least the top surface of the orifice plate. However, it is likewise contemplated that the selected layer(s) of metal can be applied to (1) both the top and bottom surfaces of the orifice plate; and (2) only the bottom surface of the plate as discussed below. Accordingly, application of the selected metallic layer to "at least one" of the top and bottom surfaces of the orifice plate shall encompass both of the alternatives listed above as well as the initial embodiment in which the metal composition is only applied to the top surface of the plate.

The completed printhead which includes the combined benefits of a non-metallic, polymeric orifice plate and an abrasion/deformation-resistant coating (e.g. made of metal or dielectric materials) may then be used to produce a thermal inkjet cartridge of improved design and efficiency. In all of the claimed embodiments involving dielectric and metallic coatings, this is accomplished by providing a housing comprising an ink-retaining compartment therein. The completed printhead is then affixed to the housing so that the printhead is in fluid communication with the compartment (and ink materials) within the housing. It is important to note that the claimed printhead, orifice plate, and benefits associated therewith are applicable to many different ink cartridges, with the present invention not being restricted to any particular cartridge designs or configurations. Likewise, the basic method associated with the invention represents an important development in inkjet technology which enables the orifice plate in the printhead to be suitably protected. This method involves (1) providing an inkjet printhead as described above which includes a substrate having ink ejectors (e.g. multiple resistors) thereon and an orifice plate positioned over and above the substrate with a top surface and a plurality of openings therethrough; and (2) depositing a protective layer of coating material directly on at least one of the top surface and the bottom surface of the orifice plate. The protective coating may again include (A) a selected dielectric composition; (B) diamond-like carbon which is a dielectric material with unique properties; and/or (C) one or more metal-containing layers. Implementation of this method may be accomplished as discussed above or in accordance with routine modifications to the foregoing process which accomplish the same result. Thus, regardless of the steps which are used to produce the improved printhead structure, the claimed method in its broadest sense represents an advance in the art of inkjet printing technology.

These and other objects, features, and advantages of the invention will be discussed below in the following Brief Description of the Drawings and Detailed Description of Preferred Embodiments.

DETAILED DESCRIPTION OF PREFERRED EMBODIMENTS

Figure 1:
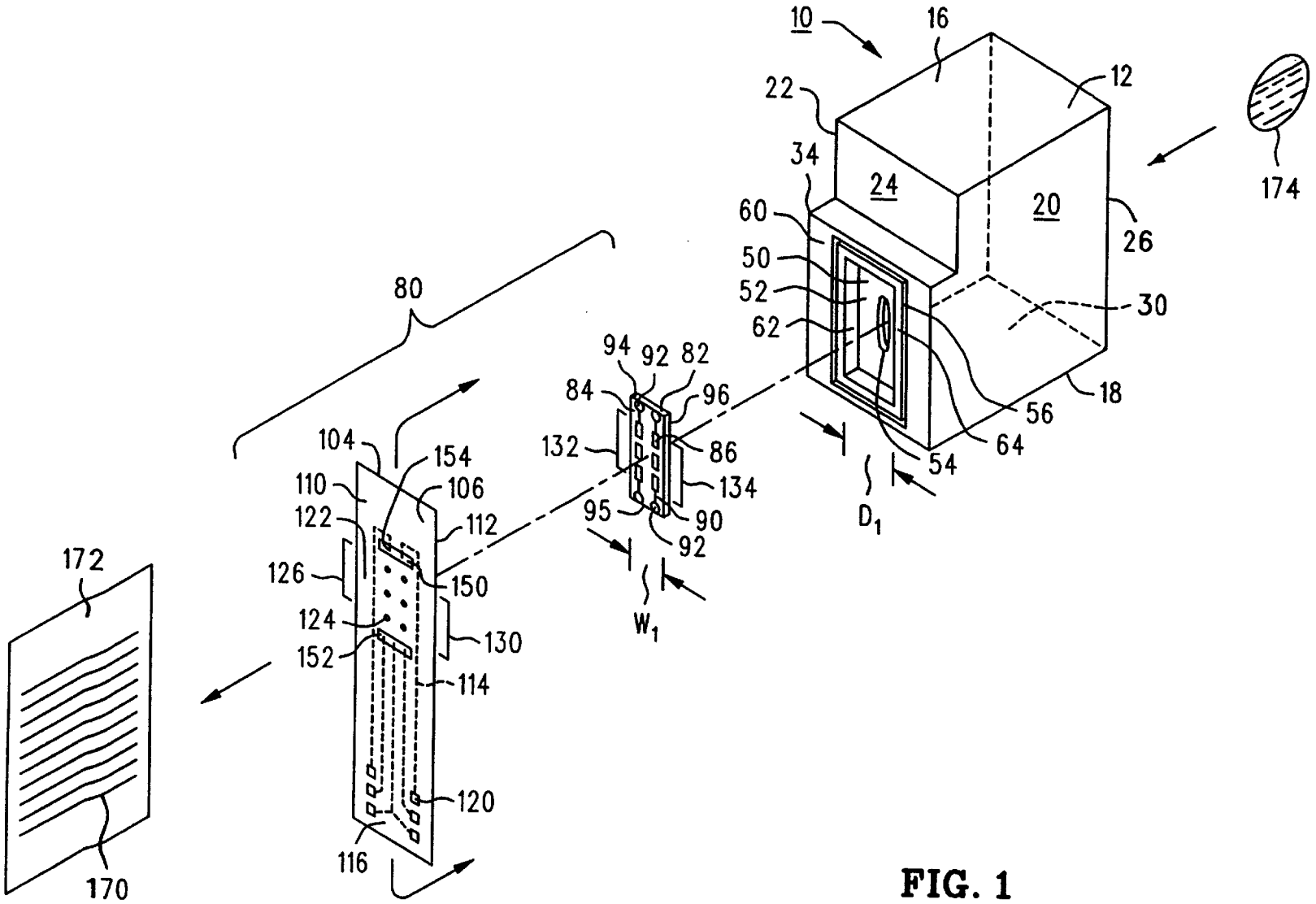
FIG. 1 is a schematic illustration of a representative thermal inkjet cartridge unit which may be used in connection with the printhead and orifice plate of the present invention.

The present invention involves a unique printhead for an inkjet printing system which includes a specialized orifice plate structure through which the ink passes. The ink is then delivered to a selected print media material (e.g. paper) using conventional inkjet printing techniques. Thermal inkjet printing systems are particularly suitable for this purpose. In accordance with a preferred embodiment of the invention, the claimed printhead systems employ an orifice plate with multiple openings therethrough which is produced from a non-metallic, organic polymer film with specific examples being provided below. To improve the durability of this structure (and the entire printhead), one or more protective coating layers are applied to the top surface (and/or the bottom surface) of the orifice plate to prevent abrasion, deformation, and/or dimpling of the structure. All of these features cooperate to create a durable, long-life printhead in which a high level of print quality is maintained. Accordingly, as discussed below, the claimed invention and manufacturing processes represent a significant advance in inkjet printing technology.

A. A Brief Overview of Thermal Inkjet Technology and a Representative Cartridge Unit As noted above, the present invention is applicable to a wide variety of ink cartridge printheads which include (1) an upper plate member having one or more openings therethrough; and (2) a substrate beneath the plate member comprising at least one or more ink "ejectors" thereon or associated therewith. The term "ink ejector" shall be defined to encompass any type of component or system which selectively ejects or expels ink materials from the printhead through the plate member. Thermal inkjet printing systems which use multiple heating resistors as ink ejectors are preferred for this purpose. However, the present invention shall not be restricted to any particular type of ink ejector or inkjet printing system as noted above. Instead, a number of different inkjet devices may be encompassed within the invention including but not limited to piezoelectric drop systems of the general type disclosed in U.S. Pat. No. 4,329,698 to Smith, dot matrix systems of the variety disclosed in U.S. Pat. No. 4,749,291 to Kobayashi et al., as well as other comparable and functionally equivalent systems designed to deliver ink using one or more ink ejectors. The specific ink-expulsion devices associated with these alternative systems (e.g. the piezoelectric elements in the system of U.S. Pat. No. 4,329,698) shall be encompassed within the term "ink ejectors" as discussed above. Accordingly, even though the present invention will be discussed herein with primary reference to thermal inkjet technology, it shall be understood that other systems are equally applicable and relevant to the claimed technology.

To facilitate a complete understanding of the present invention as it applies to thermal inkjet technology (which is the preferred system of primary interest), an overview of thermal inkjet technology will now be provided. It is important to emphasize that the claimed invention shall be not restricted to any particular type of thermal inkjet cartridge unit. Many different cartridge systems may be used in connection with the materials and processes of the invention. In this regard, the invention shall be prospectively applicable to any type of thermal inkjet system which uses a plurality of thin-film heating resistors mounted on a substrate as "ink ejectors" to selectively deliver ink materials, with the ink materials passing through an orifice plate having multiple openings therein. The ink delivery systems schematically shown in the drawing figures listed above are provided for example purposes only and are non-limiting.

With reference to FIG. 1, a representative thermal inkjet ink cartridge 10 is illustrated. This cartridge is of a general type illustrated and described in U.S. Pat. No. 5,278,584 to Keefe et al. and the *Hewlett-Packard Journal*, Vol. 39, No. 4 (August 1988), both of which are incorporated herein by reference. It is again emphasized that cartridge 10 is shown in schematic format, with more detailed information regarding cartridge 10 being provided in U.S. Pat. No. 5,278,584. As illustrated in FIG. 1, the cartridge 10 first includes a housing 12 which is preferably manufactured from plastic, metal, or a combination of both. The housing 12 further comprises a top wall 16, a bottom wall 18, a first side wall 20, and a second side wall 22. In the embodiment of FIG. 1, the top wall 16 and the bottom wall 18 are substantially parallel to each other. Likewise, the first side wall 20 and the second side wall 22 are also substantially parallel to each other.

The housing 12 further includes a front wall 24 and a rear wall 26. Surrounded by the front wall 24, top wall 16, bottom wall 18, first side wall 20, second side wall 22, and rear wall 26 is an interior chamber or compartment 30 within the housing 12 (shown in phantom lines in FIG. 1) which is designed to retain a supply of ink therein as described below. The front wall 24 further includes an externally-positioned, outwardly-extending printhead support structure 34 which comprises a substantially rectangular central cavity 50 therein. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54.

Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64 which will likewise be described in greater detail below.

With continued reference to FIG. 1, fixedly secured to housing 12 of the ink cartridge unit 10 (e.g. attached to the outwardly-extending printhead support structure 34) is a printhead generally designated in FIG. 1 at reference number 80. For the purposes of this invention and in accordance with conventional terminology, the printhead 80 actually comprises two main components fixedly secured together (with certain sub-components positioned therebetween). These components and additional information concerning the printhead 80 are provided in U.S. Pat. No. 5,278,584 to Keefe et al. which again discusses the ink cartridge 10 in considerable detail and is incorporated herein by reference. The first main component used to produce the printhead 80 consists of a substrate 82 preferably manufactured from silicon. Secured to the upper surface 84 of the substrate 82 using conventional thin film fabrication techniques is a plurality of individually energizable thin-film resistors 86 which function as "ink ejectors" and are preferably made from a tantalum-aluminum composition known in the art for resistor fabrication. Only a small number of resistors 86 are shown in the schematic representation of FIG. 1, with the resistors 86 being presented in enlarged format for the sake of clarity. Also provided on the upper surface 84 of the substrate 82 using conventional photolithographic techniques is a plurality of metallic conductive traces 90 which electrically communicate with the resistors 86. The conductive traces 90 also communicate with multiple metallic pad-like contact regions 92 positioned at the ends 94, 95 of the substrate 82 on the upper surface 84. The function of all these components which, in combination, are collectively designated herein as a resistor assembly 96 will be discussed further below. Many different materials and design configurations may be used to construct the resistor assembly 96, with the present invention not being restricted to any particular elements, materials, and components for this purpose. However, in a preferred, representative, and non-limiting embodiment discussed in U.S. Pat. No. 5,278,584 to Keefe et al., the resistor assembly 96 will be approximately 1.5 cm (0.5 inches) long, and will likewise contain 300 resistors 86 thus enabling a resolution of 600 dots per inch ("DPI"). The substrate 82 containing the resistors 86 thereon will preferably have a width "$W_1$" (FIG. 1) which is less than the distance "$D_1$" between the side walls 62, 64 of the mounting frame 56. As a result, ink flow passageways 100, 102 (schematically shown in FIG. 2) are formed on both sides of the substrate 82 so that ink flowing from the ink outlet port 54 in the central cavity 50 can ultimately come in contact with the resistors 86 as discussed further below. It should also be noted that the substrate 82 may include a number of other components thereon (not shown) depending on the type of ink cartridge unit 10 under consideration. For example, the substrate 82 may likewise include a plurality of logic transistors for precisely controlling operation of the resistors 86, as well as a "demultiplexer" of conventional configuration as discussed in U.S. Pat. No. 5,278,584. The demultiplexer is used to demultiplex incoming multiplexed signals and thereafter distribute these signals to the various thin film resistors 86. The use of a demultiplexer for this purpose enables a reduction in the complexity and quantity of the circuitry (e.g. contract regions 92 and traces 90) formed on the substrate 82. Other features of the substrate 82 (e.g. the resistor assembly 96) will be presented below.

Securely affixed to the upper surface 84 of the substrate 82 (with a number of intervening material layers therebetween including a barrier layer and an adhesive layer in the conventional design of FIG. 1) is the second main component of the printhead 80. Specifically, an orifice plate 104 is provided as shown in FIG. 1 which is used to distribute the selected ink compositions to a designated print media material (e.g. paper). Prior orifice plate designs involved a rigid plate structure manufactured from an inert metal composition (e.g. gold-plated nickel). However, recent developments in thermal inkjet technology have resulted in the use of non-metallic, organic polymer films to construct the orifice plate 104. As illustrated in FIG. 1, this type of orifice plate 104 will consist of a flexible film-type substrate 106 manufactured from a selected non-metallic organic polymer film having a nominal thickness of about 25–50 $\mu$m in a representative embodiment. For the purposes of this invention as discussed below, the term "non-metallic" shall involve a composition which does not contain any elemental metals, metal alloys, or metal amalgams. Likewise, the phrase "organic polymer" shall involve a long-chain carbon-containing structure of repeating chemical subunits. A number of different polymeric compositions may be employed for this purpose, with the present invention not being restricted to any particular construction materials. For example, the polymeric substrate 106 may be manufactured from the following compositions: polytetrafluoroethylene (e.g. Teflon®), polyimide, polymethylmethacrylate, polycarbonate, polyester, polyamide, polyethyleneterephthalate, or mixtures thereof. Likewise, a representative commercial organic polymer (e.g. polyimide-based) composition which is suitable for constructing the substrate 106 is a product sold under the trademark "KAPTON" by DuPont of Wilmington, Del. (USA). As shown in the schematic illustration of FIG. 1, the flexible orifice plate 104 is designed to "wrap around" the outwardly extending printhead support structure 34 in the completed ink cartridge 10.

Figure 2:
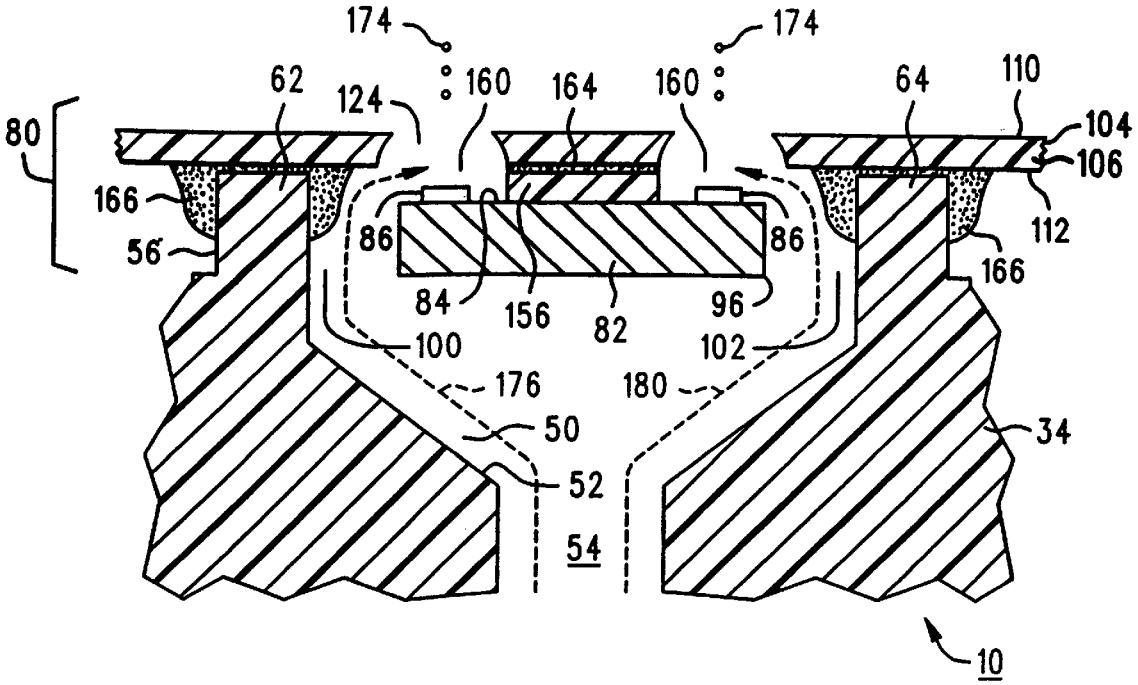
FIG. 2 is a schematic, enlarged cross-sectional view of the printhead associated with the thermal inkjet cartridge unit of FIG. 1.

The film-type substrate 106 (e.g. the orifice plate 104) further includes a top surface 110 and a bottom surface 112 (FIGS. 1 and 2). Formed on the bottom surface 112 of the substrate 106 and shown in dashed lines in FIG. 1 is a plurality of metallic (e.g. copper) circuit traces 114 which are applied to the bottom surface 112 using known metal deposition and photolithographic techniques. Many different circuit trace patterns may be employed on the bottom surface 112 of the film-type substrate 106 (orifice plate 104), with the specific pattern depending on the particular type of ink cartridge unit 10 and printing system under consideration. Also provided at position 116 on the top surface 110 of the substrate 106 is a plurality of metallic (e.g. gold-plated copper) contact pads 120. The contact pads 120 communicate with the underlying circuit traces 114 on the bottom surface 112 of the substrate via openings (not shown) through the substrate 106. During use of the ink cartridge 10 in a printer unit, the pads 120 come in contact with corresponding printer contacts in order to transmit electrical control signals from the printer to the contact pads 120 and circuit traces 114 on the orifice plate 104 for ultimate delivery to the resistor assembly 96. Electrical communication between the resistor assembly 96 and the orifice plate 104 will be discussed below.

Disposed within the middle region 122 of the substrate 106 used to produce the orifice plate 104 is a plurality of openings or orifices 124 which pass entirely through the substrate 104. These orifices 124 are shown in enlarged format in FIG. 1. Each orifice 124 in a representative embodiment will have a diameter of about 0.01–0.05 mm. In the completed printhead 80, all of the components listed above are assembled (discussed below) so that each of the orifices 124 is aligned with at least one of the resistors 86 (e.g. "ink ejectors") on the substrate 82. As result, energizing of a given resistor 86 will cause ink expulsion from the desired orifice 124 through the orifice plate 104. The claimed invention shall not be limited to any particular size, shape, or dimensional characteristics in connection with the orifice plate 104 and shall likewise not be restricted to any number or arrangement of orifices 124. In a representative embodiment as presented in FIG. 1, the orifices 124 are arranged in two rows 126, 130 on the substrate 106. Likewise, if this arrangement of orifices 124 is employed, the resistors 86 on the resistor assembly 96 (e.g. the substrate 82) will also be arranged in two corresponding rows 132, 134 so that the rows 132, 134 of resistors 86 are in substantial registry with the rows 126, 130 of orifices 124.

Finally, as shown in FIG. 1, dual rectangular windows 150, 152 are provided at each end of the rows 126, 130 of orifices 124. Partially positioned within the windows 150, 152 are beam-type leads 154 which, in a representative embodiment are gold-plated copper and constitute the terminal ends (e.g. the ends opposite the contact pads 120) of the circuit traces 114 positioned on the bottom surface 112 of the substrate 106/orifice plate 104. The leads 154 are designed for electrical connection by soldering, thermocompression bonding, and the like to the contact regions 92 on the upper surface 84 of the substrate 82 associated with the resistor assembly 96. Attachment of the leads 154 to the contact regions 92 on the substrate 82 is facilitated during mass production manufacturing processes by the windows 150, 152 which enable immediate access to these components. As a result, electrical communication is established from the contact pads 120 to the resistor assembly 96 via the circuit traces 114 on the orifice plate 104. Electrical signals from the printer unit (not shown) can then travel via the conductive traces 90 on the substrate 82 to the resistors 86 so that on-demand heating (energization) of the resistors 86 can occur.

At this point, it is important to briefly discuss fabrication techniques in connection with the structures described above which are used to manufacture the printhead 80. Regarding the orifice plate 104, all of the openings therethrough including the windows 150, 152 and the orifices 124 are typically formed using conventional laser ablation techniques as again discussed in U.S. Pat. No. 5,278,584 to Keefe et al. Specifically, a mask structure initially produced using standard lithographic techniques is employed for this purpose. A laser system of conventional design is then selected which, in a preferred embodiment, involves an excimer laser of a type selected from the following alternatives: $F_2$, ArF, KrCl, KrF, or XeCl. Using this particular system (along with preferred pulse energies of greater than about 100 millijoules/cm$^2$ and pulse durations shorter than about 1 microsecond), the above-listed openings (e.g. orifices 124) can be formed with a high degree of accuracy, precision, and control. However, the claimed invention shall not be limited to any particular fabrication method, with other methods also being suitable for producing the completed orifice plate 104 including conventional ultraviolet ablation processes (e.g. using ultraviolet light in the range of about 150–400 nm), as well as standard chemical etching, stamping, reactive ion etching, ion beam milling, and other known processes.

After the orifice plate 104 is produced as discussed above, the printhead 80 is completed by attaching the resistor assembly 96 (e.g. the substrate 82 having the resistors 86 thereon) to the orifice plate 104. In a preferred embodiment, fabrication of the printhead 80 is accomplished using tape automated bonding ("TAB") technology. The use of this particular process to produce the printhead 80 is again discussed in considerable detail in U.S. Pat. No. 5,278,584. Likewise, background information concerning TAB technology is also generally provided in U.S. Pat. No. 4,944,850 to Dion. In a TAB-type fabrication system, the processed substrate 106 (e.g. the completed orifice plate 104) which has already been ablated and patterned with the circuit traces 114 and contact pads 120 actually exists in the form of multiple, interconnected "frames" on an elongate "tape", with each "frame" representing one orifice plate 104. The tape (not shown) is thereafter positioned (after cleaning in a conventional manner to remove impurities and other residual materials) in a TAB bonding apparatus having an optical alignment sub-system. Such an apparatus is well-known in the art and commercially available from many different sources including but not limited to the Shinkawa Corporation of Japan (model no. IL-20). Within the TAB bonding apparatus, the substrate 82 associated with the resistor assembly 96 and the orifice plate 104 are properly oriented so that (1) the orifices 124 are in precise alignment with the resistors 86 on the substrate 82; and (2) the beam-type leads 154 associated with the circuit traces 114 on the orifice plate 104 are in alignment with and positioned against the contact regions 92 on the substrate 82. The TAB bonding apparatus then uses a "gang-bonding" method (or other similar procedures) to press the leads 154 onto the contact regions 92 (which is accomplished through the open windows 150, 152 in the orifice plate 104). The TAB bonding apparatus thereafter applies heat in accordance with conventional bonding processes in order to secure these components together. It is also important to note that other conventional bonding techniques may likewise be used for this purpose including but not limited to ultrasonic bonding, conductive epoxy bonding, solid paste application processes, and other similar methods. In this regard, the claimed invention shall not be restricted to any particular processing techniques associated with the printhead 80.

As previously noted in connection with the conventional cartridge unit 10 in FIG. 1, additional layers of material are typically present between the orifice plate 104 and resistor assembly 96 (e.g. substrate 82 with the resistors 86 thereon). These additional layers perform various functions including electrical insulation, adhesion of the orifice plate 104 to the resistor assembly 96, and the like. With reference to FIG. 2, the printhead 80 is illustrated in cross-section after attachment to the housing 12 of the cartridge unit 10, with attachment of these components being discussed in further detail below. As illustrated in FIG. 2, the upper surface 84 of the substrate 82 likewise includes an intermediate barrier layer 156 thereon which covers the conductive traces 90 (FIG. 1), but is positioned between and around the resistors 86 without covering them. As a result, an ink vaporization chamber 160 (FIG. 2) is formed directly above each resistor 86. Within each chamber 160, ink materials are heated, vaporized, and subsequently expelled through the orifices 124 in the orifice plate 104 as indicated below.

The barrier layer 156 (which is traditionally produced from conventional organic polymers, photoresist materials, or similar compositions as outlined in U.S. Pat. No. 5,278,584 to Keefe et al.) is applied to the substrate 82 using standard photolithographic techniques or other methods known in the art for this purpose. In addition to clearly defining the vaporization chambers 160, the barrier layer 156 also functions as a chemical and electrical insulating layer. Positioned on top of the barrier layer as shown in FIG. 2 is an adhesive layer 164 which may involve a number of different compositions including uncured poly-isoprene photoresist which is applied using conventional photolithographic and other known methods. It is important to note that the use of a separate adhesive layer 164 may, in fact, not be necessary if the top of the barrier layer 156 can be made adhesive in some manner (e.g. if it consists of a material which, when heated, becomes pliable with adhesive characteristics). However, in accordance with the conventional structures and materials shown in FIGS. 1–2, a separate adhesive layer 164 is employed.

During the TAB bonding process discussed above, the printhead 80 (which includes the previously-described components) is ultimately subjected to heat and pressure within a heating/pressure-exerting station in the TAB bonding apparatus. This step (which may likewise be accomplished using other heating methods including external heating of the printhead 80) causes thermal adhesion of the internal components together (e.g. using the adhesive layer 164 shown in the embodiment of FIG. 2). As a result, the printhead assembly process is completed at this stage.

The only remaining step involves cutting and separating the individual "frames" on the TAB strip (with each "frame" comprising an individual, completed printhead 80), followed by attachment of the printhead 80 to the housing 12 of the ink cartridge unit 10. Attachment of the printhead 80 to the housing 12 may be accomplished in many different ways. However, in a preferred embodiment illustrated schematically in FIG. 2, a portion of adhesive material 166 may be applied to either the mounting frame 56 on the housing 12 and/or selected locations on the bottom surface 112 of the orifice plate 104. The orifice plate 104 is then adhesively affixed to the housing 12 (e.g. on the mounting frame 56 associated with the outwardly-extending printhead support structure 34 shown in FIG. 1). Representative adhesive materials suitable for this purpose include commercially available epoxy resin and cyanoacrylate adhesives known in the art. During the affixation process, the substrate 82 associated with the resistor assembly 96 is precisely positioned within the central cavity 50 as illustrated in FIG. 2 so that the substrate 82 is located within the center of the mounting frame 56 (discussed above and illustrated in FIG. 2). In this manner, the ink flow passageways 100, 102 (FIG. 2) are formed which enable ink materials to flow from the ink outlet port 54 within the central cavity 50 into the vaporization chambers 160 for expulsion from the cartridge unit 10 through the orifices 124 in the orifice plate 104.

To generate a printed image 170 on a selected image-receiving medium 172 (e.g. paper) using the cartridge unit 10, a supply of a selected ink composition 174 (schematically illustrated in FIG. 1) which resides within the interior compartment 30 of the housing 12 passes into and through the ink outlet port 54 within the bottom wall 52 of the central cavity 50. The ink composition 174 thereafter flows into and through the ink flow passageways 100, 102 in the direction of arrows 176, 180 toward the substrate 82 having the resistors 86 thereon (e.g. the resistor assembly 96). The ink composition 174 then enters the vaporization chambers 160 directly above the resistors 86. Within the chambers 160, the ink composition 174 comes in contact with the resistors 86. To activate (e.g. energize) the resistors 86, the printer system (not shown) which contains the cartridge unit 10 causes electrical signals to travel from the printer unit to the contact pads 120 on the top surface 110 of the substrate 106 of the orifice plate 104. The electrical signals then pass through vias (not shown) within the plate 104 and subsequently travel along the circuit traces 114 on the bottom surface 112 of the plate 104 to the resistor assembly 96 containing the resistors 86. In this manner, the resistors 86 can be selectively energized (e.g. heated) in order to cause ink vaporization and resultant expulsion of ink from the printhead 80 via the orifices 124 through the orifice plate 104. The ink composition 174 can then be delivered in a highly selective, on-demand basis to the selected image-receiving medium 172 to generate an image 170 thereon (FIG. 1).

It is important to emphasize that the printing process discussed above is applicable to a wide variety of different thermal inkjet cartridge designs. In this regard, the inventive concepts discussed below shall not be restricted to any particular printing system. However, a representative, non-limiting example of a thermal inkjet cartridge of the type described above which may be used in connection with the claimed invention involves an inkjet cartridge sold by the Hewlett-Packard Company of Palo Alto, Calif. (USA) under the designation "51645A." Likewise, further details concerning thermal inkjet processes in general are outlined in the *Hewlett-Packard Journal*, Vol. 39, No. 4 (August 1988), U.S. Pat. No. 4,500,895 to Buck et al., and U.S. Pat. No. 4,771,295 to Baker et al. Having discussed conventional thermal inkjet components and printing methods associated therewith, the claimed invention and its beneficial features will now be presented.

B. The Printhead Structures and Methods of the Present Invention

As previously noted, the claimed invention and its various embodiments enable the production of an orifice plate and a thermal inkjet printhead with an improved degree of durability. The term "durability" again involves a variety of characteristics including abrasion and deformation-resistance, as well as enhanced structural integrity. Both abrasion and deformation of the orifice plate can occur during contact between the orifice plate and a variety of structures encountered during the printing process including wiper-type structures made of rubber and the like which are typically incorporated within conventional printer units. Deformation and abrasion of the orifice plate not only decreases the overall life of the printhead and ink cartridge, but likewise causes a deterioration in print quality over time. Specifically, deformation of the orifice plate can result in the generation of printed images which are distorted and indistinct with a loss of resolution. The term "durability" also includes a situation in which the orifice plate is sufficiently rigid to avoid problems associated with "dimpling". Ruffling traditionally involves a situation in which orifice plates made of non-metallic, polymeric materials undergo deformation or other deviations at the orifice exits which are caused by physical abrasion. Deformation of the polymeric material around the orifice exits may cause misdirected droplets of ink to be expelled. Dimpling is likewise associated with the non-planar orifice plate surface during assembly of the printhead or the non-planar mounting of the printhead to the cartridge unit. The resultant orifices will exhibit trajectory errors due to the non-planar orifice plate. This is because the drops will assume trajectories that are roughly perpendicular to the surface of the orifice member immediately surrounding the orifice. Therefore ruffling and dimpling present a substantial number of problems including misdirection of the ink droplets expelled from the printhead which results in improperly-printed images. Accordingly, all of these factors are important in producing a completed inkjet printing system which has a long life-span and is capable of producing clear and distinct printed images.

Figure 3:
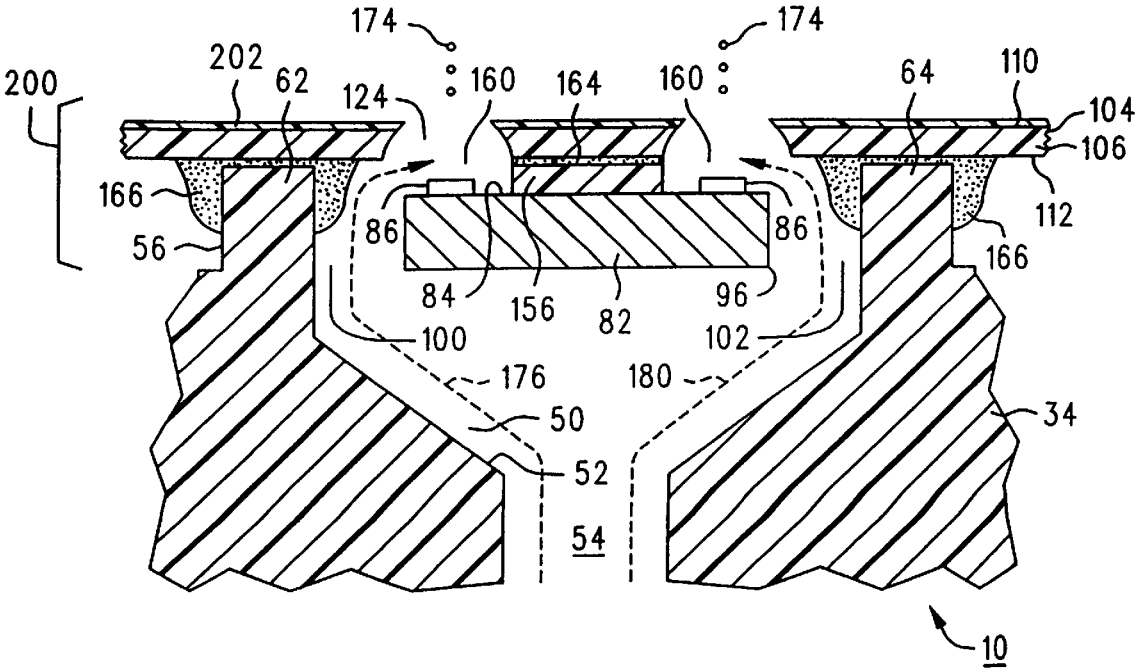
FIG. 3 is a schematic, enlarged cross-sectional view of a representative thermal inkjet printhead produced in accordance with the invention which includes at least one protective coating layer of a dielectric composition positioned on the top surface of the orifice plate.

With reference to FIG. 3, an enlarged, schematically-illustrated thermal inkjet printhead 200 produced in accordance with a first embodiment of the invention is illustrated. Reference numbers in FIG. 3 which correspond with those in FIG. 2 signify parts, components, and elements that are common to the printheads shown in both figures. Such common elements are discussed above in connection with the printhead 80 of FIG. 2, with the discussion of these elements being incorporated by reference with respect to the printhead 200 illustrated in FIG. 3. At this point, it is again important to emphasize that, in a preferred embodiment, the substrate 106 used to produce the orifice plate 104 in the embodiment of FIG. 3 is non-metallic (e.g. non-metal-containing) and consists of a selected organic polymer film. The term "non-metallic" shall involve a composition which does not contain any elemental metals, metal alloys, or metal amalgams. Likewise, the term "organic polymer" shall encompass a long-chain carbon-containing structure of repeating chemical subunits. Representative organic polymers suitable for producing the substrate 106 associated with the orifice plate 104 in the embodiment of FIG. 3 include polytetrafluoroethylene (e.g. Teflon®), polyimide, polymethylmethacrylate, polycarbonate, polyester, polyamide, polyethylene-terephthalate, or mixtures thereof. Likewise, a representative commercial organic polymer (e.g. polyimide-based) composition which may be used for this purpose is a product sold under the trademark "KAPTON" by DuPont of Wilmington, Del. (USA). The differences between the prior printhead design of FIG. 2 and the inventive design of FIG. 3 will now be presented.

As shown in FIG. 3, an additional material layer is provided on the top surface 110 of the substrate 106 used to produce the orifice plate 104 which provides considerable functional benefits (e.g. strength, durability, rigidity, dimple-avoidance, uniform wettability, and the like). With reference to FIG. 3, a protective layer of coating material 202 is deposited directly on at least a portion (e.g. all or part) of the top surface 110 of the substrate 106 associated with the orifice plate 104. In the printhead 200 of FIG. 3, the coating material 202 will consist of at least one dielectric composition, with the term "dielectric" being defined to involve a material that is electrically-insulating and substantially non-conductive. Representative dielectric materials suitable for this purpose include but are not limited to silicon nitride ($Si_3N_4$), silicon dioxide ($SiO_2$), boron nitride (BN), silicon carbide (SiC), and a composition known as "silicon carbon oxide" which is commercially available under the name Dylyn® from Advanced Refractory Technologies, Inc. of Buffalo, N.Y. In a preferred embodiment, the layer of coating material 202 will be provided on the substrate 106 at or near the middle region 122 (FIG. 1) of the orifice plate 104 which is again defined to involve the region immediately adjacent to and surrounding the orifices 124 through the orifice plate 104. However, it is also contemplated that the entire top surface 110 (or any other selected portion) of the substrate 106/orifice plate 104 could be covered with the protective layer of coating material 202, following by etching of the coating material 202 where needed (e.g. using conventional reactive ion etching, chemical etching, or other known etching techniques). Regardless of where the layer of dielectric coating material 202 is deposited, it is preferred that it have a uniform thickness of about 1000–3000 angstroms, although the exact thickness level to be employed in any given situation will vary, depending on the particular components used in the printhead 200 and other external factors as determined by preliminary pilot testing.

At this point, it is important to emphasize that, in a preferred embodiment, the substrate 106 used to produce the orifice plate 104 in the system of FIG. 3 is non-metallic (e.g. non-metal-containing) and consists of a selected organic polymeric film-type composition as discussed above. The use of this particular material to manufacture an orifice plate represents a departure from conventional technology which involved the use of metallic (e.g. gold-plated nickel) structures. It is an important inventive development in this case to apply a selected dielectric composition directly onto a non-metallic organic polymer orifice plate 104. The combination of these materials produces an orifice plate 104 which is light, readily manufactured using mass-production techniques, and resistant to abrasion, deformation and dimpling (as defined above). Accordingly, application of the selected dielectric materials to a non-metallic orifice plate 104 of the type described herein represents an advance in thermal inkjet technology.

Many different production methods and processing equipment may be employed to deliver the protective layer of coating material 202 onto the top surface 110 of the substrate 106 associated with the orifice plate 104. In this regard, the present invention shall not be limited to any particular process steps or techniques. For example, the following methods can be used to deliver (e.g. directly deposit) the selected dielectric coating material 202 onto the substrate 106: (1) plasma vapor deposition ("PVD"); (2) chemical vapor deposition ("CVD"); (3) sputtering; and (4) delivery systems. Techniques (1)–(3) are well known in the art and described in a book by Elliott, D. J., entitled *Integrated Circuit Fabrication Technology*, McGraw-Hill Book Company, New York, 1982 (ISBN No. 0-07-019238-3), pp. 1–23. Basically, PVD processes involve a technique in which gaseous materials are altered to convert them into vaporized chemical compositions using an rf-based system. These reactive gaseous species are then employed to vapor-deposit the materials under consideration. Further information concerning plasma vapor deposition processes is presented in U.S. Pat. No. 4,661,409 to Kieser et al. CVD methods are similar to PVD techniques and involve a situation in which coatings of selected materials can be formed on a substrate in a system which thermally decomposes various gases to yield a desired product. For example, gaseous materials which may be employed to produce a coating of silicon nitride ($Si_3N_4$) on a substrate include $SiH_4$ and $NH_3$. Likewise $SiH_4$ and CO may be used to yield a coating layer of silicon dioxide ($SiO_2$) on a substrate. Further information concerning CVD processes is presented in U.S. Pat. No. 4,740,263 to Imai et al. Sputtering techniques involve ionized gas materials which are produced using a high energy electromagnetic field and thereafter delivered to a supply of the material to be deposited. As a result, this material is dispersed onto a selected substrate. Other conventional processes in addition to those listed above which may be employed to deposit the selected layer of dielectric coating material 202 include (A) ion beam deposition methods; (B) thermal evaporation techniques; and the like.

Application of the selected dielectric composition as the protective layer of coating material 202 may be undertaken at any time during the printhead production process which, as noted above, makes extensive use of tape automated bonding (e.g. "TAB") methods generally disclosed in U.S. Pat. No. 4,944,850 to Dion. Thus, the claimed invention and fabrication process shall not be limited to any particular sequence and order of steps. However, in a preferred embodiment, the selected coating material 202 will be applied to the orifice plate 104 by one of the above-listed techniques during the fabrication process associated with the orifice plate 104. In particular, coating will preferably occur prior to attachment of the substrate 106 to the resistor assembly 96 and before laser ablation of the substrate 106 to form the orifices 124 through the orifice plate 104. After the layer of dielectric coating material 202 is applied, conventional laser ablation processes can then be performed to create the orifices 124 in the orifice plate 104 as discussed above. However, in certain cases as determined by preliminary testing, the layer of coating material 202 can be applied after the orifices 124 have been formed in the substrate 106.

Figure 4:
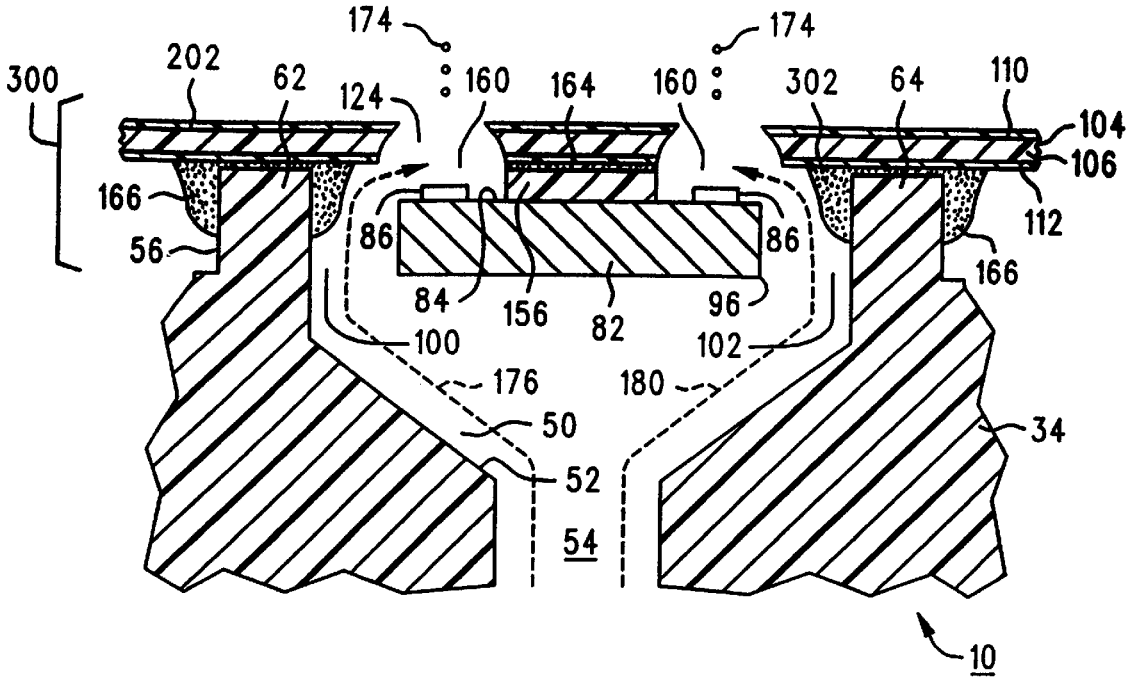
FIG. 4 is a schematic, enlarged cross-sectional view of a representative thermal inkjet printhead produced in accordance with an alternative embodiment of the invention which includes at least one protective coating layer of a dielectric composition positioned on both the top and bottom surfaces of the orifice plate.

A further modification of the printhead 200 is illustrated in FIG. 4 with reference to printhead 300. In the printhead 300 of FIG. 4, a protective layer of coating material 302 may also be applied to the bottom surface 112 of the substrate 106 used to produce the orifice plate 104, along with the layer of coating material 202 deposited on the top surface 10 of the substrate 106. This additional layer of coating material 302 will optimally involve the same dielectric materials listed above in connection with the primary layer of coating material 202. Likewise, all of the other information provided above in connection with the coating material 202 (including deposition and manufacturing methods, as well as a preferred thickness level of about 1000–3000 angstroms) is equally applicable to the additional layer of coating material 302. The only difference between the embodiments of FIG. 3 and FIG. 4 is the presence of the layer of coating material 302 which is optimally applied to the bottom surface 112 of the substrate 106 at the same time that the layer of coating material 202 is deposited onto the top surface 10 of the substrate 106. As a result, an orifice plate 104 is produced in which both the top and bottom surfaces 110, 112 are coated with a strength-imparting, dimple-resisting dielectric material which further enhances the structural integrity of the entire printhead 300.

It should also be noted that the printhead 300 shown in FIG. 4 may be further modified to eliminate the layer of coating material 202 from the top surface 110 of the orifice plate 104. As a result, only the layer of coating material 302 on the bottom surface 112 of the substrate 106/orifice plate 104 is present as shown FIG. 5. This "modified" printhead is designated at reference number 400 in FIG. 5. While it is preferred that the layer of coating material 202 on the top surface 10 of the substrate 106 be present to achieve maximum protection of the orifice plate 104, the modified orifice plate 104 discussed above and shown in FIG. 5 which only includes the layer of coating material 302 on the bottom surface 112 may be useful in connection with lower-stress situations where only one layer of strength-imparting material on the orifice plate 104 is necessary.

Figure 5:
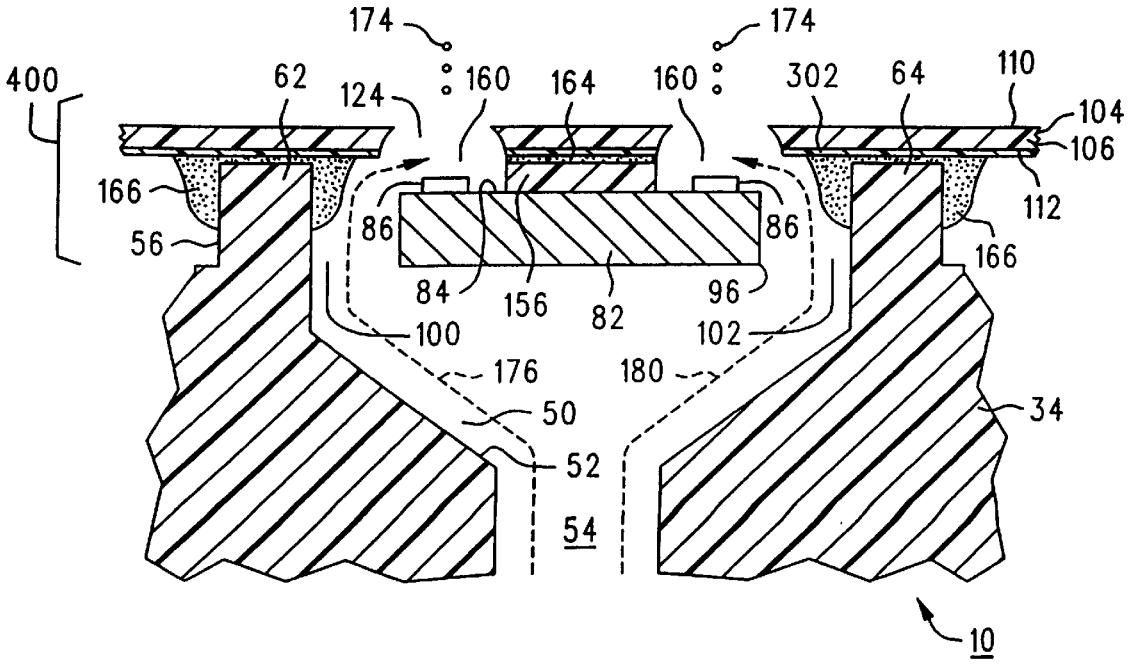
FIG. 5 is a schematic, enlarged cross-sectional view of a representative thermal inkjet printhead produced in accordance with a further alternative embodiment of the invention which includes at least one protective coating layer of a dielectric composition positioned on only the bottom surface of the orifice plate.

In a still further variation of the present invention, a specific dielectric material which may be employed as the protective layer of coating material 202 and/or coating material 302 on the orifice plate 104 in the embodiments of FIGS. 3–5 is a composition known as "diamond-like carbon" or "DLC". This material is particularly well-suited for this purpose in view of its strength, flexibility, resilience, high modulus for stiffness, favorable adhesion characteristics, and inert character. DLC is discussed specifically in U.S. Pat. No. 4,698,256 to Giglia, and particularly involves a very hard and durable carbon-based material with diamond-like characteristics. On an atomic level, DLC (which is also characterized as "amorphous carbon") consists of carbon atoms molecularly attached using $sp^3$ bonding although $sp^2$ bonds may also be present. As a result, DLC exhibits many traits of conventional diamond materials (e.g. hardness, inertness, and the like) while also having certain characteristics associated with graphite (which is dominated by $sp^2$ bonding). It also adheres in a strong and secure manner to the overlying and underlying materials (e.g. polymeric barrier layers and the like) which are typically present in thermal inkjet printheads. When applied to a substrate, DLC is very smooth with considerable hardness and abrasion resistance. In this regard, it is an ideal material for use as the protective layer of coating material 202 (and/or layer of coating material 302) on the orifice plate 104 in the printheads 200, 300, 400 (FIGS. 3–5). Additional information concerning DLC, as well as manufacturing techniques for applying this material to a selected substrate are discussed in U.S. Pat. No. 4,698,256 to Giglia et al.; U.S. Pat. No. 5,073,785 to Jansen et al.; U.S. Pat. No. 4,661,409 to Kieser et al.; and U.S. Pat. No. 4,740,263 to Imai et al. However, all of the information provided above regarding application of the other dielectric materials to the orifice plate 104 (including thickness levels) is equally applicable to the delivery of DLC to the orifice plate 104. Specifically, the following delivery methods may again be used for DLC deposition onto the top surface 110 and/or bottom surface 112 of the orifice plate 104 as discussed and defined above: (1) plasma vapor deposition ("PVD"); (2) chemical vapor deposition ("CVD"); (3) sputtering; (4) ion beam deposition methods; and (5) thermal evaporation techniques. Processing steps involving the deposition of DLC (and the order in which they are undertaken) are the same as those discussed above in connection with the other dielectric materials delivered to the orifice plate 104 in the embodiments of FIGS. 3–5. The foregoing information is therefore incorporated by reference in this section of the present disclosure. However, it is important to emphasize that the use of DLC as a protective coating on the outer surface of a non-metallic, organic polymer-containing orifice plate is an important development which results in a unique composite structure (e.g. one or more diamond-like carbon layers+a polymeric organic layer). This specific structure and its use in the claimed printheads 200, 300, 400 again provides many benefits ranging from exceptional abrasion-resistance and a high modulus of stiffness to the control of dimpling and improved adhesion characteristics.

The completed printheads 200, 300, 400 shown in FIGS. 3–5 which include the combined benefits of a non-metallic polymer-containing orifice plate 104 and an abrasion resistant, highly durable dielectric coating material 202, 302 thereon may then be used to produce a thermal inkjet cartridge unit of improved design and effectiveness. This is accomplished by securing the completed printhead 200 (or printheads 300, 400) to the housing 12 of the inkjet cartridge 10 shown in FIG. 1 in the same manner discussed above in connection with attachment of the printhead 80 to the housing 12. As a result, the printhead 200 (or printheads 300, 400) will be in fluid communication with the internal chamber 30 inside the housing 12 which contains the selected ink composition 174. Accordingly, the discussion provided above regarding attachment of the printhead 80 to the housing 12 is equally applicable to attachment of the printhead 200 (or printheads 300, 400) in position to produce a completed thermal inkjet cartridge 10 with improved durability characteristics. It is again important to emphasize that the claimed printheads 200, 300, 400 and the benefits associated therewith are applicable to a wide variety of different thermal inkjet cartridge systems, with the present invention not being restricted to any particular cartridge designs or configurations. A representative cartridge system which may be employed in combination with the printhead 200 (or printheads 300, 400) is again disclosed in U.S. Pat. No. 5,278,584 to Keefe et al. and is commercially available from the Hewlett-Packard Company of Palo Alto, Calif. (USA)—product no. 51645A. Furthermore, while the present invention described above in connection with the embodiments of FIGS. 3–5 primarily involves an orifice plate 104 constructed from a non-metallic organic polymer composition, it is also contemplated that a metallic orifice plate (e.g. made of gold-plated nickel) of the type discussed in U.S. Pat. No. 4,500,895 to Buck et al. can likewise be treated with a selected dielectric composition (including DLC). All of the information provided above regarding the application of these compositions to the organic polymer-type orifice plate 104 is therefore equally applicable to metallic orifice plate systems (including thickness levels, deposition methods, and the like. Likewise, the basic method associated with the embodiments of FIGS. 3–5 represents an important development in thermal printing technology. This basic method involves: (1) providing an inkjet printhead which includes a substrate having multiple ink ejectors (e.g. resistors) thereon and an orifice plate positioned over the substrate with a top surface, a bottom surface, and a plurality of orifices therethrough; and (2) depositing a protective, strength-imparting layer of coating material directly onto any portion of the top and/or bottom surfaces of the orifice plate. The protective coating in the embodiments of FIG. 3–5 (which are related by the use of common coating materials) again involves a selected dielectric composition, with DLC providing excellent results. This method for protecting an orifice plate on a printhead may be accomplished in accordance with the techniques discussed above or through the use of routine modifications to the listed processes. Regardless of which steps are actually employed to manufacture the improved printheads 200, 300, 400 of FIGS. 3–5, the claimed method in its broadest sense (which involves applying a protective dielectric coating to an orifice plate in a printhead) represents an advance in the art of thermal inkjet technology.

Figure 6:
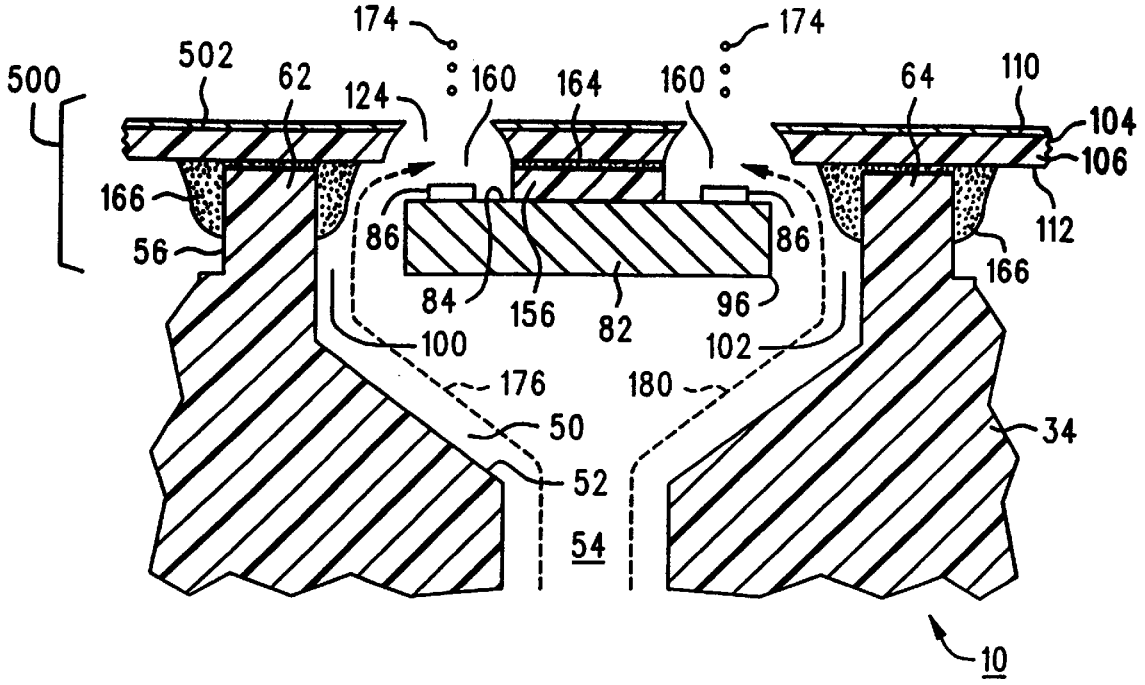
FIG. 6 is a schematic, enlarged cross-sectional view of a representative thermal inkjet printhead produced in accordance with a still further alternative embodiment of the invention which includes at least one protective coating layer of a selected metal composition positioned on the top surface of the orifice plate.

Another alternative printhead design is illustrated schematically and in enlarged format in FIG. 6 at reference number 500. This embodiment likewise provides the same benefits listed above, namely, improved durability (e.g. abrasion and deformation-resistance). However, as discussed in detail below, it involves the deposition of at least one layer of a selected metal composition directly onto the top surface 110 of the substrate 106 used to produce the orifice plate 104. The claimed invention shown in FIG. 6 shall not be restricted to any particular metal materials for this purpose, with a wide variety of metals being suitable for use including chromium (Cr), nickel (Ni), palladium (Pd), gold (Au), titanium (Ti), tantalum (Ta), aluminum (Al), and mixtures (e.g. compounds) thereof. In this embodiment, the term "metal composition" shall be defined to encompass an elemental metal, a metal alloy, or a metal amalgam. Likewise, the phrase "at least one" in connection with the metal-containing layer shown in FIG. 6 (discussed further below) shall signify a situation in which one or multiple layers of a selected metal composition can be employed, with the final structure associated with the printhead 500 being determined by preliminary pilot testing. Accordingly, this embodiment of the present invention shall not be restricted to any particular number or arrangement of metal-containing layers on the orifice plate 104, wherein one or more layers will function effectively. The claimed invention of FIG. 6 in its broadest sense will therefore involve the novel concept of applying at least one layer of a selected metal composition to an orifice plate in an ink ejector-containing printhead wherein the orifice plate is preferably comprised of a non-metallic, organic polymer. As a result, a unique "metal+polymer" orifice plate system is provided in the printhead 500.

With specific reference to the FIG. 6, a cross-sectional, schematic, and enlarged view of the printhead 500 is provided. Reference numbers in FIG. 6 which correspond with those in FIG. 2 signify parts, components, and elements that are common to the printheads shown in both figures. Such common elements are described above in connection with the printhead 80 of FIG. 2, with the discussion of these elements being incorporated by reference with respect to the printhead 500 illustrated in FIG. 6. At this point, it is again important to emphasize that the substrate 106 used to produce the orifice plate 104 in the embodiment of FIG. 6 is preferably non-metallic (e.g. non-metal-containing) and consists of a selected organic polymer film. The term "non-metallic" shall involve a composition which does not contain any elemental metals, metal alloys, or metal amalgams. Likewise, the term "organic polymer" shall encompass a long-chain carbon-containing structure of repeating chemical subunits. Representative organic polymers suitable for producing the substrate 106 associated with the orifice plate 104 in the embodiment of FIG. 6 again include polytetrafluoroethylene (e.g. Teflon®), polyimide, polymethylmethacrylate, polycarbonate, polyester, polyamide, polyethlene-terephthalate, or mixtures thereof. Likewise, a representative commercial organic polymer (e.g. polyimide-based) composition which may be used for this purpose is a product sold under the trademark "KAPTON" by DuPont of Wilmington, Del. (USA). The differences between the prior printhead design of FIG. 2 and the inventive design of FIG. 6 will now be presented.

In accordance with the discussion provided above, at least part (e.g. some or all) of the upper surface 10 of the substrate 106 used to produce the orifice plate 104 in the printhead 500 is covered with at least one protective layer of coating material being comprised of one or more metal compositions. In FIG. 6, the metallic layer of coating material is designated at reference number 502. The metallic composition associated with the layer of coating material 502 shall not be restricted to any particular metal materials for this purpose, with a wide variety of metals being suitable for use including chromium (Cr), nickel (Ni), palladium (Pd), gold (Au), titanium (Ti), tantalum (Ta), aluminum (Al), and mixtures (e.g. compounds) thereof as previously noted. Deposition of the metallic coating material 502 is accomplished using conventional techniques which are known in the art for this purpose including all of those listed above in the embodiments of FIGS. 3–5. These methods include (1) plasma vapor deposition ("PVD"); (2) chemical vapor deposition ("CVD"); (3) sputtering; (4) ion beam deposition methods; and (5) thermal evaporation techniques. Definitions, information, and supporting background references regarding these techniques are discussed above and incorporated by reference in this section of the present disclosure. The selection of any given deposition method will be determined by preliminary pilot studies in accordance with the specific materials selected for use in the printhead 500. Likewise, to achieve optimum results, the metallic layer of coating material 502 will have a thickness of about 200–5000 angstroms, with the exact thickness level for a given situation again being determined by preliminary analysis.

Figure 7:
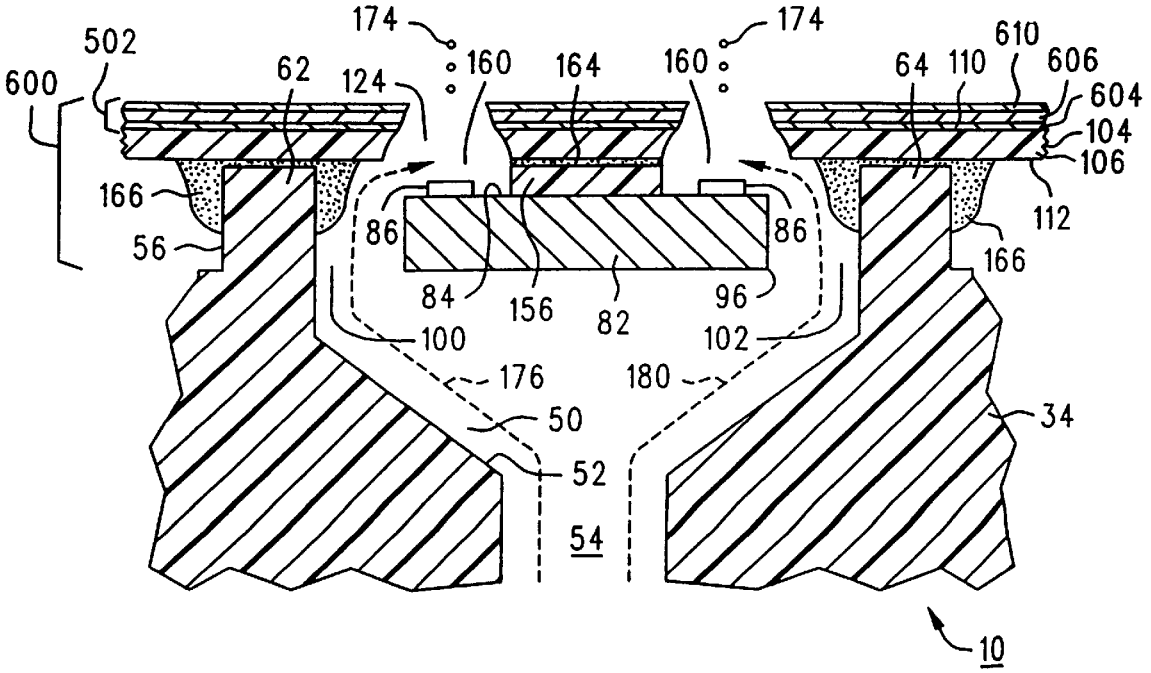
FIG. 7 is a schematic, enlarged cross-sectional view of a representative thermal inkjet printhead produced in accordance with the embodiment of FIG. 6 in which a specific group of multiple metal-containing layers is used in connection with the protective metallic coating layer positioned on the top surface of the orifice plate.

The representative example of FIG. 6 incorporates a single layer of coating material 502. However, the term "at least one" as it applies to the metallic coating layer(s) delivered to the top surface 10 of the orifice plate 104 shall again be defined to involve one or more individual layers of material. FIG. 7 involves a modification of printhead 500 shown at reference number 600 in which the basic layer of coating material 502 actually consists of three separate metal-containing sub-layers which each function as individual layers of coating material. As illustrated in the specific example of FIG. 7 (which is designed to produce ideal strength and adhesion characteristics), the protective layer of metallic coating material 502 initially consists of a first layer (e.g. sub-layer) of metal 604 deposited directly on the top surface 110 of the substrate 106/orifice plate 104. The first layer of metal 604 is designed to function as a "seed" layer which effectively bonds the other metal sub-layers 606, 610 to the orifice plate 104 as shown in FIG. 7. Metal compositions selected for this purpose should be capable of strong adhesion to the organic polymers used in connection with the orifice plate 104. Representative metals suitable for use in the first layer of metal 604 in the three-layer embodiment of FIG. 7 involve a first metal composition selected from the group consisting of chromium (Cr), nichrome, tantalum nitride, tantalum-aluminum, and mixtures thereof. Again, the first layer of metal 604 is deposited directly on the top surface 110 of the substrate 106/orifice plate 104 using one or more of the deposition techniques listed above in connection with the basic layer of coating material 502. Prior to deposition of the first layer of metal 604, ideal results will be achieved if the top surface 110 of the substrate 106 is pre-treated to remove adsorbed species and contaminants therefrom. Pre-treatment may be accomplished using known techniques including but not limited to conventional ion bombardment processes. In a preferred embodiment, the first layer of "seed" metal 604 will have a uniform thickness of about 25–600 angstroms.

Next, a second layer (e.g. sub-layer) of metal 606 is deposited directly on top of the first layer of metal 604 using one or more of the previously-described deposition techniques. The second layer of metal 606 is designed to impart strength, rigidity, anti-dimpling characteristics, and deformation-resistance to the orifice plate 104. Representative metals suitable for this purpose involve a second metal composition selected from the group consisting of titanium (Ti), nickel (Ni), copper (Cu) and mixtures thereof, with the second layer of metal 606 having a preferred thickness of about 1000–3000 angstroms.

Deposited directly on top of the second layer of metal 606 is a third and final layer (e.g. sub-layer) of metal 610 shown in FIG. 7. Application of the third layer of metal 610 is again accomplished using one or more of the above-described deposition techniques. The third layer of metal 610 is designed to impart both corrosion resistance and reduced friction to the completed orifice plate 104 (especially with respect to the first and second layers of metal 604, 606 which are positioned beneath the third layer of metal 610). To achieve optimum results, the third layer of metal 610 will be about 100–300 angstroms thick.

The resulting protective layer of metallic coating material 502 shown in FIGS. 6–7 (which, in the non-limiting embodiment of FIG. 7, involves a composite of multiple (e.g. three) metal layers 604, 606, 610) provides the benefits listed above, namely, improved abrasion resistance, dimpling control, and uniform wettability. However, as previously noted, any number of metal-containing layers (e.g. one or more) may be deposited on the top surface 110 of the substrate 106 associated with the orifice plate 104. For example, titanium (Ti) has excellent "seed" and strength-imparting characteristics. A single increased-thickness layer of titanium may therefore be used instead of the dual layers 604, 606 listed above, followed by application of the final layer 610 onto the titanium layer. Regardless of whether a single metal layer or multiple metal layers are used as the protective layer of coating material 502 in the embodiment of FIGS. 6–7, it is preferred that the layer of coating material 502 have a total (combined) thickness level of about 200–5000 angstroms. Again, this value may be varied in accordance with preliminary tests involving the specific printhead components of interest.

Application of the protective layer of metallic coating material 502 to the substrate 106 associated with the orifice plate 104 may be undertaken at any time during the printhead production process which, as noted above, makes extensive use of tape automated bonding (e.g. "TAB") methods disclosed in U.S. Pat. No. 4,944,850 to Dion. Thus, the claimed invention and fabrication process shall not be restricted to any particular processing steps and order in which these steps are taken. However, to achieve optimum results, the metal composition(s) used to produce the protective layer of coating material 502 (whether one or more layers are involved) will be applied to the polymeric substrate 106/orifice plate 104 prior to attachment of the substrate 106 to the resistor assembly 96. Regarding laser ablation of the substrate 106 to form the orifices 124 therethrough, preliminary testing will be employed to determine whether ablation should occur before or after metal layer deposition. In the embodiment shown in FIG. 7 and discussed above, laser ablation will optimally occur after deposition of the first or "seed" layer of metal 604 and before delivery of the second and third layers of metal 606, 610 onto the first layer of metal 604. In other variations of the printhead 500 (and printhead 600 involving different numbers of metal "sub-layers" associated with the main layer of coating material 502), laser ablation will take place after metal delivery in situations where the deposited metal to be ablated has a thickness of less than about 400 angstroms. In situations where the deposited metal layer(s) have a combined thickness of 400 angstroms or more, ablation will typically occur before metal deposition. However, it is important to re-emphasize that the claimed invention shall not be restricted to any specific production methods which shall be determined in accordance with a routine preliminary analysis.

Figure 8:
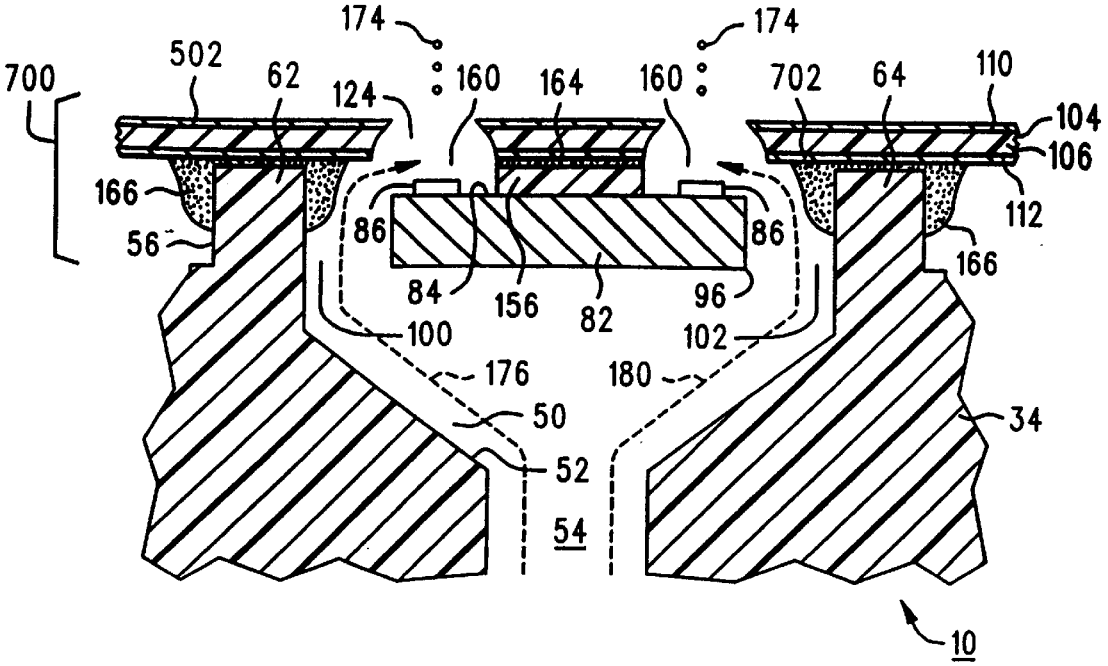
FIG. 8 is a schematic, enlarged cross-sectional view of a representative thermal inkjet printhead produced in accordance with a still further alternative embodiment of the invention which includes at least one protective coating layer of a selected metal composition positioned on both the top surface and bottom surface of the orifice plate.

A still further modification to the printhead 500 described above and shown in FIG. 6 is illustrated in FIG. 8 at reference number 700. In printhead 700, a protective layer of metallic coating material 702 is applied to the bottom surface 112 of the substrate 106 used to produce the orifice plate 104. This additional layer of coating material 702 will involve the same metal compositions previously described in connection with the primary layer of coating material 502 (e.g. one or more individual layers of the representative metals listed above). Likewise, all of the other information provided above in connection with the layer of coating material 502 (including thickness values, deposition processes, and manufacturing methods) is equally applicable to the additional layer of coating material 702. The only difference of consequence between the embodiments of FIG. 6 and FIG. 8 is the presence of the additional layer of metallic coating material 702 which is applied to the bottom surface 112 of the orifice plate 104. The additional layer of metallic coating material 702 may be applied to the bottom surface 112 of the orifice plate 104 at the same time that the layer of metallic coating material 502 is deposited onto the top surface 110 of the substrate 106, or may be applied at different times. As a result, an orifice plate 104 is produced in which both the top and bottom surfaces 110, 112 are coated with strength-imparting, dimple-resisting metallic compositions which further enhance the overall structural integrity of the entire printhead 700. Incidentally, it should be noted that the layer of metallic coating material 502 on the top surface 110 of the orifice plate 104 in the embodiment of FIG. 8 may also involve the multi-layer coating configuration illustrated in FIG. 7 wherein three separate metal "sub-layers" 604, 606, 610 are employed for this purpose.

Figure 9:
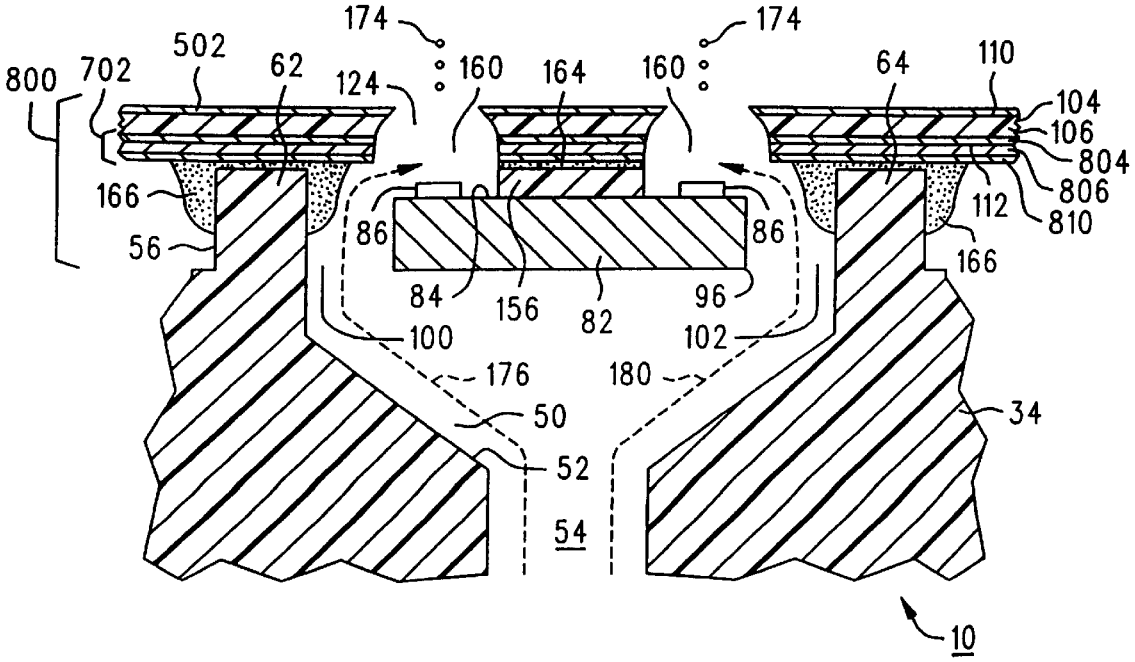
FIG. 9 is a schematic, enlarged cross-sectional view of a representative thermal inkjet printhead produced in accordance with the embodiment of FIG. 8 in which a specific group of multiple metal-containing layers is used in connection with the protective metallic coating layer positioned on the bottom surface of the orifice plate.

While the embodiment of FIG. 8 uses a single metal layer in connection with the coating material 702 on the bottom surface 112 of the orifice plate 104, one or more individual layers of a selected metal composition may also be employed for this purpose. With reference to FIG. 9, a modified printhead 800 is provided which involves the use of sequentially-applied multiple metallic layers in connection with the layer of coating material 702. Specifically a primary layer (e.g. sub-layer) of metal 804 is deposited directly on the bottom surface 112 of the substrate 106/orifice plate 104. The primary layer of metal 804 is designed to function as a "seed" layer which effectively bonds the other metal sub-layers 806, 810 (discussed below) to the orifice plate 104 as shown in FIG. 9. Metal compositions selected for this purpose should be capable of strong adhesion to the organic polymers used to form the orifice plate 104. Representative metals suitable for use in the primary layer of "seed" metal 804 preferably involve the same compositions listed above in connection with the first layer of metal 604 in the embodiment of FIG. 7. Specifically, the primary layer of metal 804 will optimally consist of a first metal composition selected from the group consisting of chromium (Cr), nichrome, tantalum nitride, tantalum-aluminum, and mixtures thereof. Again, the primary layer of metal 804 is deposited directly on the bottom surface 112 of the substrate 106 using one or more of the deposition techniques listed above. Prior to deposition of the primary layer of metal 804 onto the substrate 106, ideal results will be achieved if the bottom surface 112 of the substrate 106 is pre-treated to remove adsorbed species and contaminants. Pre-treatment may be accomplished using known techniques including but not limited to conventional ion bombardment processes. In a preferred embodiment, the primary layer of metal 804 will have a uniform thickness of about 25–600 angstroms.

Next, a secondary layer (e.g. sub-layer) of metal 806 (FIG. 9) is deposited directly onto the primary layer of metal 804 using one of the previously-described deposition techniques. The secondary layer of metal 806 is designed to impart additional strength, rigidity, anti-dimpling characteristics, and deformation-resistance to the orifice plate 104. Representative metals suitable for this purpose are preferably the same as those listed above in connection with the second layer of metal 606 in the embodiment of FIG. 7. Specifically, the secondary layer of metal 806 in FIG. 9 will optimally consist of a second metal composition selected from the group consisting of nickel (Ni), titanium (Ti), copper (Cu), and mixtures thereof, with the secondary layer of metal 806 having a preferred thickness of about 1000–3000 angstroms.

Deposited directly onto the secondary layer of metal 806 is a tertiary and final layer (e.g. sub-layer) of metal 810 shown in FIG. 9. Application of the tertiary layer of metal 810 is again accomplished using one or more of the above-described deposition techniques. The tertiary layer of metal 810 is primarily designed to impart corrosion resistance to the completed orifice plate 104 (especially with respect to the first and second layers of metal 804, 806 which are positioned above the tertiary layer of metal 810). To achieve optimum results, the tertiary layer of metal 810 will be about 100–300 angstroms thick. However, any number of metal-containing layers (e.g. one or more) may be deposited on the bottom surface 112 of the substrate 106 associated with the orifice plate 104. For example, titanium (Ti) has excellent "seed" and strength-imparting characteristics. A single increased-thickness layer of titanium may therefore be used instead of the dual layers 804, 806 listed above, followed by application of the final layer 810 onto the titanium layer. In addition, it should also be noted that the metallic coating material 502 on the top surface 110 of the orifice plate 104 in the embodiment of FIG. 9 may also involve the multi-layer coating configuration shown in FIG. 7 in which three separate metal "sub-layers" 604, 606, 610 are employed for this purpose.

Figure 10:
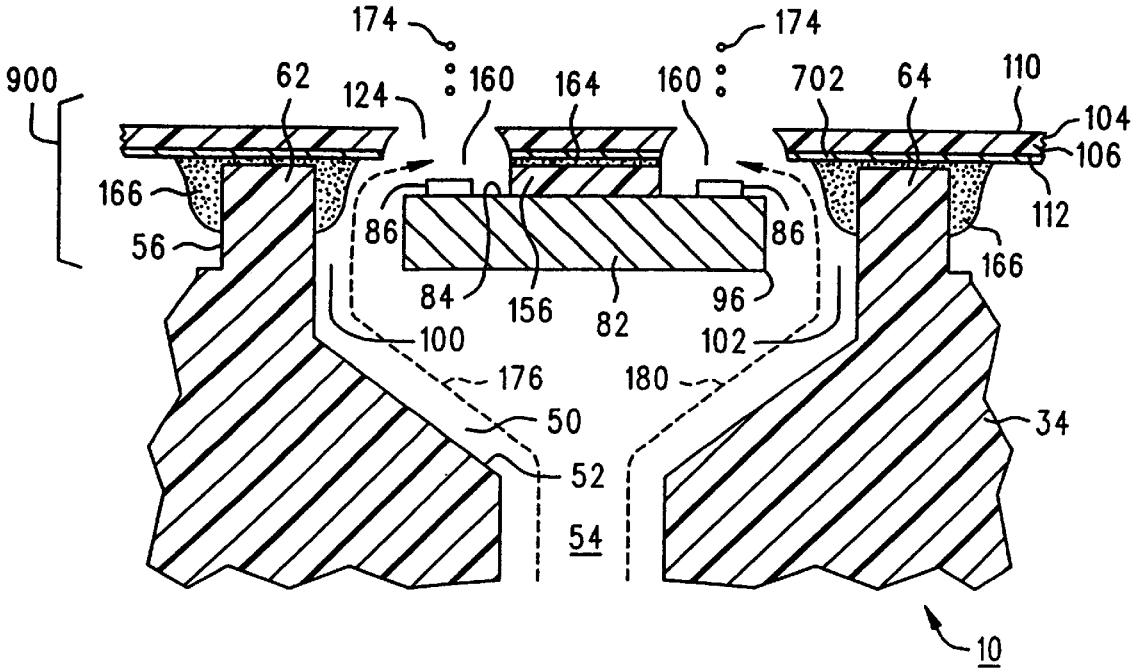
FIG. 10 is a schematic, enlarged cross-sectional view of a representative thermal inkjet printhead produced in accordance with an even further alternative embodiment of the invention which includes at least one protective coating layer of a selected metal composition positioned on only the bottom surface of the orifice plate.

The printheads 700, 800 of FIGS. 8–9 may be further modified to produce an additional printhead 900 illustrated in FIG. 10. In printhead 900, the main layer of metallic coating material 502 on the top surface 110 of the orifice plate 104 is eliminated. As a result, only the additional layer of coating material 702 on the bottom surface 112 of the substrate 106/orifice plate 104 will be present as shown in FIG. 10. While it is preferred that the layer of coating material 502 on the top surface 110 of the substrate 106 be present to achieve maximum protection of the orifice plate 104, the modified orifice plate 104 discussed above and shown in FIG. 10 which only includes the coating material 702 on the bottom surface 112 may be useful in connection with lower-stress situations in which only one layer of strength-imparting material on the orifice plate 104 is necessary.

The completed printheads 500, 600, 700, 800, 900 shown in FIGS. 6–10 which include the combined benefits of a non-metallic polymer-containing orifice plate 104 and an abrasion resistant, metal-containing layer of coating material 502, 702 thereon may then be used to produce a thermal inkjet cartridge unit of improved design and effectiveness. This is accomplished by securing the completed printhead 500 (or printheads 600–900) to the housing 12 of the inkjet cartridge 10 shown in FIG. 1 in the same manner discussed above in connection with attachment of the printhead 80 to the housing 12. As a result, the printhead 500 (or the other printheads 600–900 listed above) will be in fluid communication with the internal chamber 30 inside the housing 12 which contains the selected ink composition 174. Accordingly, the discussion provided above regarding attachment of the printhead 80 to the housing 12 is equally applicable to attachment of the printhead 500 (or printheads 600–900) in position to produce a completed thermal inkjet cartridge 10 with improved durability characteristics. It is again important to emphasize that the claimed printheads 500–900 and the benefits associated therewith are applicable to a wide variety of different thermal inkjet cartridge systems (or other types of inkjet delivery units), with the present invention not being restricted to any particular cartridge designs or configurations. A representative cartridge system which may be employed in combination with the printheads 500–900 is disclosed in U.S. Pat. No. 5,278,584 to Keefe et al. and is commercially available from the Hewlett-Packard Company of Palo Alto, Calif. (USA)—product no. 51645A. It is also important to note that the previously-discussed metal compositions may be applied to all or part of the selected orifice plate structure at any location on the top or bottom surfaces thereof for the above-described purposes and additional benefits. Thus, the claimed invention shall not be restricted to any locations or portions of the orifice plate on which the selected metal compositions are applied.

Likewise, the basic method associated with the embodiments of FIGS. 6–10 represents an important development in inkjet printing technology. This basic method involves: (1) providing an inkjet printhead which includes a substrate having multiple ink ejectors (e.g. resistors) thereon and an orifice plate positioned over the substrate with a top surface, a bottom surface, and a plurality of orifices therethrough; and (2) depositing a protective layer of coating material directly on at least one of the top surface and bottom surface of the orifice plate. The protective coating in the embodiments of FIGS. 6–10 (which are related by the use of common coating materials) again involves a selected metal composition. This method for protecting a non-metallic, polymer-containing orifice plate on a printhead may be accomplished in accordance with the techniques discussed above or through the use of routine modifications to the listed processes. Regardless of which steps are actually employed to manufacture the improved printheads 500–900 of FIGS. 6–10, the claimed method in its broadest sense (which, in a preferred embodiment, involves applying a protective metallic coating to a non-metallic, organic polymer-containing orifice plate) represents an advance in the art of inkjet technology.

All of the embodiments described above provide a common benefit, namely, the production of an inkjet printhead with substantially improved strength, durability, structural integrity, and operating efficiency. Specifically, the printheads and orifice plates of the present invention are: (1) dimensionally stable; (2) dimpling and abrasion-resistant; (3) resistant to deformation; and (4) have desirable [uniform] ink wetting characteristics. These goals are accomplished by the unique printhead designs discussed above which represent a significant advance in the art of inkjet technology. Having herein described preferred and optimum embodiments of the present invention, it is anticipated that modifications may be made thereto which nonetheless remain within the scope of the invention. For example, the invention shall not be limited to any particular manufacturing methods, dimensions, and other production parameters in connection with the claimed printheads, orifice plates, ink cartridges, and methods. Accordingly, the present invention shall only be construed in connection with the following claims.

What is claimed is:

1. A printhead for use in an ink cartridge comprising:

a substrate comprising an upper surface, said upper surface comprising at least one ink ejector thereon;

an orifice plate member comprised of a non-metallic organic polymer composition positioned over and above said substrate comprising said ink ejector thereon, said orifice plate member further comprising a top surface, a bottom surface, and a plurality of openings passing entirely through said orifice plate member; and a protective layer of coating material positioned on at least one of said top surface and said bottom surface of said orifice plate member, said protective layer of coating material being comprised of a composition selected from the group consisting of silicon nitride, silicon dioxide, boron nitride, silicon carbide, and silicon carbon oxide.

2. The printhead of claim 1 wherein said non-metallic organic polymer composition used to produce said orifice plate member is selected from the group consisting of polytetrafluoroethylene, polyimide, polymethylmethacrylate, polycarbonate, polyester, polyamide, polyethylene-terephthalate, and mixtures thereof.

3. The printhead of claim 1 wherein both of said top surface and said bottom surface of said orifice plate member comprise said protective layer of coating material positioned thereon.

4. A printhead for use in an ink cartridge comprising:

a substrate comprising an upper surface, said upper surface comprising at least one ink ejector thereon;

an orifice plate member comprised of a non-metallic organic polymer composition positioned over and above said substrate comprising said ink ejector thereon, said orifice plate member further comprising a top surface, a bottom surface, and a plurality of openings passing entirely through said orifice plate member; and a protective layer of coating material positioned on at least one of said top surface and said bottom surface of said orifice plate member, said protective layer of coating material being comprised of diamond-like carbon.

5. The printhead of claim 4 wherein said non-metallic organic polymer composition used to produce said orifice plate member is selected from the group consisting of polytetrafluoroethylene, polyimide, polymethylmethacrylate, polycarbonate, polyester, polyamide, polyethylene-terephthalate, and mixtures thereof.

6. The printhead of claim 4 wherein both of said top surface and said bottom surface of said orifice plate member comprise said protective layer of coating material positioned thereon.

7. A printhead for use in an ink cartridge comprising:

a substrate comprising an upper surface, said upper surface comprising at least one ink ejector thereon;

an orifice plate member comprised of a non-metallic organic polymer composition positioned over and above said substrate comprising said ink ejector thereon, said orifice plate member further comprising a top surface, a bottom surface, and a plurality of openings passing entirely through said orifice plate member;

a first layer of coating material positioned on said top surface of said orifice plate, said first layer of coating material being comprised of a first metal composition;

a second layer of coating material positioned on said first layer of coating material, said second layer of coating material being comprised of a second metal composition, said second metal composition being different from said first metal composition; and a third layer of coating material positioned on said second layer of coating material, said third layer of coating material being comprised of a third metal composition, said third metal composition being different from said second metal composition.

8. An ink cartridge comprising:

a housing comprising an ink-retaining compartment therein; and a printhead affixed to said housing and in fluid communication with said compartment in said housing, said printhead comprising:

a substrate comprising an upper surface, said upper surface comprising at least one ink ejector thereon;

an orifice plate member comprised of a non-metallic organic polymer composition positioned over and above said substrate comprising said ink ejector thereon, said orifice plate member further comprising a top surface, a bottom surface, and a plurality of openings passing entirely through said orifice plate member; and a protective layer of coating material positioned on at least one of said top surface and said bottom surface of said orifice plate member, said protective layer of coating material being comprised of a composition selected from the group consisting of silicon nitride, silicon dioxide, boron nitride, silicon carbide, and silicon carbon oxide.

9. An ink cartridge comprising:

a housing comprising an ink-retaining compartment therein; and a printhead affixed to said housing and in fluid communication with said compartment therein, said printhead comprising:

a substrate comprising an upper surface, said upper surface comprising at least one ink ejector thereon;

an orifice plate member comprised of a non-metallic organic polymer composition positioned over and above said substrate comprising said ink ejector thereon, said orifice plate member further comprising a top surface, a bottom surface, and a plurality of openings passing entirely through said orifice plate member; and a protective layer of coating material positioned on at least one of said top surface and said bottom surface of said orifice plate member, said protective layer of coating material being comprised of diamond-like carbon.

10. A method for protecting the orifice plate member in an ink cartridge printhead comprising:

providing a printhead comprising:

a substrate comprising an upper surface, said upper surface comprising at least one ink ejector thereon; and an orifice plate member comprised of a non-metallic organic polymer composition positioned over and above said substrate comprising said ink ejector thereon, said orifice plate member further comprising a top surface, a bottom surface, and a plurality of openings passing entirely through said orifice plate member; and depositing a protective layer of coating material on at least one of said top surface and said bottom surface of said orifice plate member, said protective layer of coating material being comprised of a composition selected from the group consisting of silicon nitride, silicon dioxide, boron nitride, silicon carbide, and silicon carbon oxide.

11. A printhead for use in an ink cartridge comprising:

a substrate comprising an upper surface, said upper surface comprising at least one ink ejector thereon;

an orifice plate member comprised of a non-metallic organic polymer composition positioned over and above said substrate comprising said ink ejector thereon, said orifice plate member further comprising a top surface, a bottom surface, and a plurality of openings passing entirely through said orifice plate member;

a seed layer of coating material positioned on at least one of said top surface and said bottom surface of said orifice plate member, said seed layer of coating material being comprised of a first metal composition; and an additional layer of coating material positioned on said seed layer of coating material, said additional layer of coating material being comprised of a second metal composition that is different from said first metal composition.

12. A method for protecting the orifice plate member in an ink cartridge printhead comprising:

providing a printhead comprising:

a substrate comprising an upper surface, said upper surface comprising at least one ink ejector thereon; and an orifice plate member comprised of a non-metallic organic polymer composition positioned over and above said substrate comprising said ink ejector thereon, said orifice plate member further comprising a top surface, a bottom surface, and a plurality of openings passing entirely through said orifice plate member;

selecting a first metal composition for placement on at least one of said top surface and said bottom surface of said orifice plate member;

depositing a seed layer of coating material comprised of said first metal composition on said at least one of said top surface and said bottom surface of said orifice plate member;

selecting a second metal composition that is different from said first metal composition for placement on said seed layer of coating material; and depositing an additional layer of coating material comprised of said second metal composition on said seed layer of coating material.

13. A method for protecting the orifice plate member in an ink cartridge printhead comprising:

providing a printhead comprising:

a substrate comprising an upper surface, said upper surface comprising at least one ink ejector thereon; and an orifice plate member comprised of a non-metallic organic polymer composition positioned over and above said substrate comprising said ink ejector thereon, said orifice plate member further comprising a top surface, a bottom surface, and a plurality of openings passing entirely through said orifice plate member; and depositing a protective layer of coating material on at least one of said top surface and said bottom surface of said orifice plate member, said protective layer of coating material being comprised of diamond-like carbon.

14. A printhead for use in an ink cartridge comprising:

a substrate comprising an upper surface, said upper surface comprising at least one ink ejector thereon;

an orifice plate member positioned over and above said substrate comprising said ink ejector thereon, said orifice plate member further comprising a top surface, a bottom surface, and a plurality of openings passing entirely through said orifice plate member, and a protective layer of coating material positioned on at least one of said top surface and said bottom surface of said orifice plate member, said protective layer of coating material being comprised of silicon carbon oxide.

* * * * *